US007242888B2

(12) United States Patent
Ishii

(10) Patent No.: US 7,242,888 B2
(45) Date of Patent: Jul. 10, 2007

(54) IMAGE FORMING APPARATUS WITH PROCESSING UNIT THAT CAN BE REMOVED FROM THE IMAGE FORMING APPARATUS WITHOUT REMOVING EXPOSING DEVICES

(75) Inventor: Masahiro Ishii, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 29 days.

(21) Appl. No.: 10/809,366

(22) Filed: Mar. 26, 2004

(65) Prior Publication Data

US 2004/0190932 A1 Sep. 30, 2004

(30) Foreign Application Priority Data

Mar. 28, 2003 (JP) ..... 2003-092410

(51) Int. Cl.
*G03G 15/00* (2006.01)

(52) U.S. Cl. ..... 399/110

(58) Field of Classification Search ..... 399/130, 399/297, 310–312, 112, 118, 179, 298, 299
See application file for complete search history.

(56) References Cited

U.S. PATENT DOCUMENTS 5,065,195 A * 11/1991 Haneda et al. ..... 399/112
5,839,028 A 11/1998 Nomura et al.
5,845,176 A 12/1998 Yoshida et al.
5,950,052 A * 9/1999 Nomura et al. ..... 399/167
5,978,626 A * 11/1999 Nagamine et al. ..... 399/125
6,219,508 B1 4/2001 Nagatomi et al.
6,236,820 B1 * 5/2001 Nakazato et al. ..... 399/111
6,349,192 B1 * 2/2002 Yoshino et al. ..... 399/302
6,381,428 B1 * 4/2002 Yamamoto et al. ..... 399/116
6,400,917 B2 * 6/2002 Nakazato et al. ..... 399/111
6,408,142 B1 6/2002 Takeuchi et al.
6,453,135 B1 * 9/2002 Sameshima et al. ..... 399/110
6,459,868 B1 * 10/2002 Takahashi et al. ..... 399/110
6,463,242 B1 * 10/2002 Kojima et al. ..... 399/258
6,466,754 B2 * 10/2002 Nakazato et al. ..... 399/111
6,473,572 B1 * 10/2002 Uchiyama et al. ..... 399/24
6,483,527 B2 * 11/2002 Kaneko et al. ..... 347/138
6,501,925 B2 * 12/2002 Yamamoto et al. ..... 399/116

(Continued)

FOREIGN PATENT DOCUMENTS

EP 0 791 861 A2 8/1997

(Continued)

*Primary Examiner*—Diego Gutierrez
*Assistant Examiner*—Dixomara Vargas
(74) *Attorney, Agent, or Firm*—Oliff & Berridge, PLC

(57) ABSTRACT

A tandem color laser printer, in which processing units can be smoothly attached to and detached from its casing, is provided while an adequate accuracy of exposure to photosensitive drums is maintained. In the color laser printer, scanning units are fixed to the printer casing. The processing units and the scanning units are alternately aligned and overlapped. A top cover is provided to a side opposite to a transfer position where the photosensitive drums contact a conveyor belt so as to freely open and close with respect to the printer casing. With this structure, the adequate accuracy of exposure by the scanning units can be maintained. The processing units can be attached to and detached from the printer casing via an upper opening of the printer casing defined by the opened top cover. Thus, the processing units can be smoothly attached to and detached from the printer casing without being interfered by the scanning units.

32 Claims, 13 Drawing Sheets

U.S. PATENT DOCUMENTS

| | | | | |
|---|---|---|---|---|
| 6,546,213 | B2 * | 4/2003 | Ito et al. | 399/27 |
| 6,697,586 | B2 * | 2/2004 | Yamamoto et al. | 399/110 |
| 6,707,480 | B2 * | 3/2004 | Ameyama et al. | 347/129 |
| 6,751,428 | B2 | 6/2004 | Okabe | |
| 6,785,492 | B2 * | 8/2004 | Tanizaki et al. | 399/113 |
| 6,788,321 | B2 * | 9/2004 | Araki et al. | 347/138 |
| 6,799,011 | B2 * | 9/2004 | Abe et al. | 399/299 |
| 6,882,823 | B2 * | 4/2005 | Matsuyama et al. | 399/401 |
| 6,968,143 | B2 * | 11/2005 | Blair et al. | 399/124 |
| 2004/0265000 | A1 | 12/2004 | Okabe | |

FOREIGN PATENT DOCUMENTS

| | | | |
|---|---|---|---|
| EP | 1 091 266 | A2 | 4/2001 |
| EP | 1 098 228 | A2 | 5/2001 |
| EP | 1 331 524 | A2 | 7/2003 |
| JP | U-63-11638 | | 1/1988 |
| JP | A-8-54786 | | 2/1996 |
| JP | A-8-190245 | | 7/1996 |
| JP | A 9-274423 | | 10/1997 |
| JP | A-11-38721 | | 2/1999 |
| JP | A 2001-166555 | | 6/2001 |
| JP | A-2001-249601 | | 9/2001 |
| JP | A-2002-82509 | | 3/2002 |
| JP | A-2003-84645 | | 3/2003 |

* cited by examiner

IMAGE FORMING APPARATUS WITH PROCESSING UNIT THAT CAN BE REMOVED FROM THE IMAGE FORMING APPARATUS WITHOUT REMOVING EXPOSING DEVICES

BACKGROUND OF THE INVENTION

1. Field of Invention

The invention relates to an image forming apparatus such as a color laser printer.

2. Description of Related Art

As an electrophotographic color laser printer, there exists a so-called tandem color laser printer that includes a plurality of processing units, each of which has a developing agent hopper, a developing roller and a photosensitive drum, with respect to toner colors of yellow, magenta, cyan, and black.

In the above tandem color laser printer, toner images of the respective colors are formed on the respective photosensitive drums at almost the same instant by which toner particles stored in the developing agent hopper are supplied onto the photosensitive drum by the developing roller in each of the processing units. Therefore, a color image can be formed at a speed that is almost the same as an image forming speed of a monochrome laser printer.

As the above tandem color laser printer, Japanese Laid-Open Patent Publication No. 9-274423 discloses a color laser printer that is structured as described below. In each processing unit of the color laser printer, a photosensitive drum is disposed opposite to a conveyor belt for conveying a sheet. A developing roller is disposed on one side of the photosensitive drum. A recording head, which exposes the photosensitive drum to light in order to form an electrostatic latent image thereon, is provided opposite to the conveyor belt while sandwiching the photosensitive drum therebetween.

SUMMARY OF THE INVENTION

In the color laser printer disclosed in Japanese Laid-Open Patent Publication No. 9-274423, it is necessary to provide the recording head near the photosensitive drum in order to prevent an exposure failure of the recording head with respect to the photosensitive drum. Therefore, as described above, the recording head is disposed opposite to the conveyor belt while sandwiching the photosensitive drum therebetween. However, with such placement, the recording head interferes with the replacement of the photosensitive drum. Thus, the recording head is fixed to an upper cover so as to move with the upper cover in accordance with the opening and closing of the upper cover.

However, when the recording head moves every time the upper cover opens and closes, there may be variations in the relative position of the recording head to the photosensitive drum, which may cause an image to be deviated.

The invention thus provides, among other things, a tandem image forming apparatus wherein processing units can be smoothly attached to and detached from the image forming apparatus while providing adequate accuracy in exposing the photosensitive drums.

According to one exemplary aspect of the invention, an image forming apparatus includes processing units for respective colors of developing agents, each of which can be attached to and detached from an image forming apparatus body. The processing units include a developing agent storage chamber that stores developing agent therein, a developing agent holding member that holds the developing agent, and an image holding member that holds a developing agent image that is formed by development of an electrostatic latent image by the developing agent held by the developing agent holding member. The image forming apparatus also includes exposing devices for the respective colors of the developing agents, each of which is fixed to the image forming apparatus body and scans a laser beam to the image holding member in order to form the electrostatic latent image onto the image holding member, and a cover member that is provided on a side opposite to a transfer position where the developing agent image held by the image holding member is transferred and that opens and closes with respect to the image forming apparatus body. The processing units and the exposing devices are alternately disposed, and the processing units are attached to and detached from the image forming apparatus body via an opening defined by the cover member that is opened with respect to the image forming apparatus body.

According to the structure described above, the processing units and the exposing devices are alternately disposed. With this structure, the processing units can be attached to and detached from the image forming apparatus body, without removing the exposing devices from the positions, via the opening defined by which the cover member opens with respect to the image forming apparatus body, on the side opposite to the side of the transfer position where the developing agent image held by the image holding member is transferred.

According to another exemplary aspect of the invention, an image forming apparatus includes processing units for respective colors of developing agents, each of which can be attached to and detached from a image forming apparatus body. The processing units include a developing agent storage chamber that stores developing agent therein, a developing agent holding member that holds the developing agent, and an image holding member that holds a developing agent image that is formed by development of an electrostatic latent image by the developing agent held by the developing agent holding member. The image forming apparatus also includes exposing devices for the respective colors of the developing agents, each of which is fixed to the image forming apparatus body and forms the electrostatic latent image onto the image holding member, and a cover member that is provided on a side opposite to a transfer position where the developing agent image held by the image holding member is transferred and that opens and closes with respect to the image forming apparatus body. The processing units are attached to and detached from the image forming apparatus body via an opening defined by the cover member that is opened with respect to the image forming apparatus body, and the image holding member, the developing agent holding member and the developing agent storage chamber are overlapped in a direction to attach and detach the processing units, in each of the processing units.

According to another exemplary aspect of the invention, an image forming apparatus includes processing units for respective colors of developing agents each of which can be attached to and detached from an image forming apparatus body. The processing units include a developing portion that includes a developing agent storage chamber that stores developing agent therein and a developing agent holding member that holds the developing agent and an image holding portion that includes an image holding member that holds a developing agent image that is formed by development of an electrostatic latent image by the developing agent held by the developing agent holding member. The image forming apparatus also includes exposing devices for the respective colors of the developing agents, each of which is fixed to the image forming apparatus body and scans a laser beam to the image holding member in order to form the electrostatic latent image onto the image holding member. The developing portion and the image holding portion can be attached to and detached from the image forming apparatus body in a state where the developing portion and the image holding portion are integrated with each other, and the developing portion can be attached to and detached from the image holding portion.

BRIEF DESCRIPTION OF THE DRAWINGS

Embodiments of the invention will be described in detail with reference to the following figures wherein.

DETAILED DESCRIPTION OF PREFERRED EMBODIMENTS

Embodiments of the invention will be described with reference to the accompanying drawings.

Figure 1:
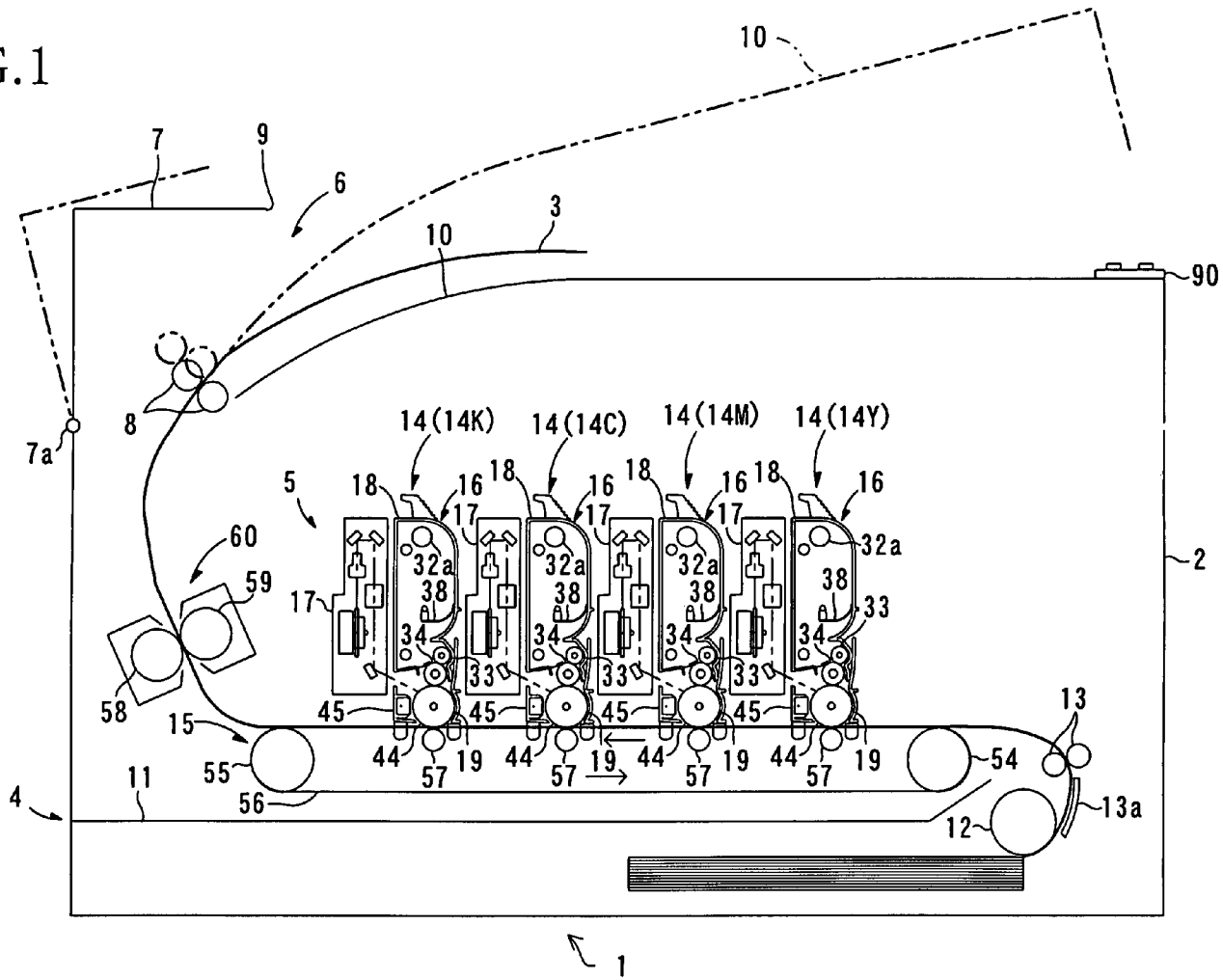
FIG. 1 is a side sectional view showing essential parts of a color laser printer (a horizontal installation type) as an image forming apparatus of the invention.

As shown in FIG. 1, a color laser printer 1 is a so-called tandem color laser printer of a horizontal installation type, wherein four processing portions 14 (described later) are aligned parallel with each other, in a horizontal direction. The color laser printer 1 includes a printer casing 2 as an image forming apparatus body, a sheet feeding portion 4 that feeds a sheet 3 as a recoding medium, an image forming portion 5 that forms an image onto the fed sheet 3, and a sheet discharge portion 6 that discharges the sheet 3 having the image thereon.

The printer casing 2 has a rectangular box shape when viewed from the side and has no upper wall. The printer casing 2 is provided with a top cover 7 (i.e., cover member) at the opening and at a position opposite to a transfer position where photosensitive drums 44 contact a conveyor belt 56 in the transfer portion 15. The top cover 7 is rotatably supported via a hinge 7*a* at a rear of the printer casing 2 (hereinafter, the left hand side and the right hand side of FIG. 1 are referred to as the rear and the front throughout the drawings) so as to freely open and close with respect to the printer casing 2 as shown by a double dashed chain line.

The top cover 7 includes a sheet discharge port 9 through which a sheet 3 is discharged, a recessed sheet output tray 10 whose portion near the sheet discharge port 9 is deeply recessed in order to stack sheets 3 discharged from the sheet discharge port 9 thereon, and a pair of discharge rollers 8 disposed at a rear end portion of the sheet output tray 10 in the sheet discharge portion 9. When the top cover 7 opens or closes, the sheet discharge port 9, the sheet output tray 10 and the pair of discharge rollers 8 integrally move with the top cover 7.

At a front end portion of the top cover 7, an operating panel 90 is provided through which a user performs settings of various items of the color laser printer 1.

The sheet feeding portion 4 includes a sheet feeding tray 11, which is detachably attached to the bottom of the printer casing 2 in the horizontal direction from the front, a sheet supply roller 12, which is disposed at a position above one end of the sheet feeding tray 11, and a pair of conveyor rollers 13, which are disposed above and downstream of the sheet supply roller 12 in a sheet conveying direction.

The sheet feeding tray 11 accommodates a stack of sheets 3 therein. A topmost sheet 3 in the stack is separated from the stack and is supplied toward the pair of conveyor rollers 13, one by one, by the rotation of the sheet supply roller 12. Then, the sheet 3 is further conveyed between the conveyor belt 56 and each of the photosensitive drums 44 (transfer positions) by the pair of conveyor rollers 13.

A guide member 13*a* is disposed between the sheet supply roller 12 and the pair of conveyor rollers 13 so as to extend in the up and down direction. The sheet 3 supplied by the sheet supply roller 12 is guided to the conveyor rollers 13 by the guide member 13*a* and then further conveyed between the conveyor belt 56 and each of the photosensitive drums 44 (the transfer positions) provided in a rearward position, by the pair of conveyor rollers 13.

The image forming portion 5 includes the processing portions 14, the transfer portion 15 and a fixing portion 60. The processing portions 14 are provided for respective colors of toners. That is, the processing portions 14 include an yellow processing portion 14Y, a magenta processing portion 14M, a cyan processing portion 14C and a black processing portion 14K. These processing portions 14 are horizontally aligned in the front to rear direction, in this order, at a predetermined distance away from each other and overlap each other when viewed from the horizontal direction.

Figure 2B:
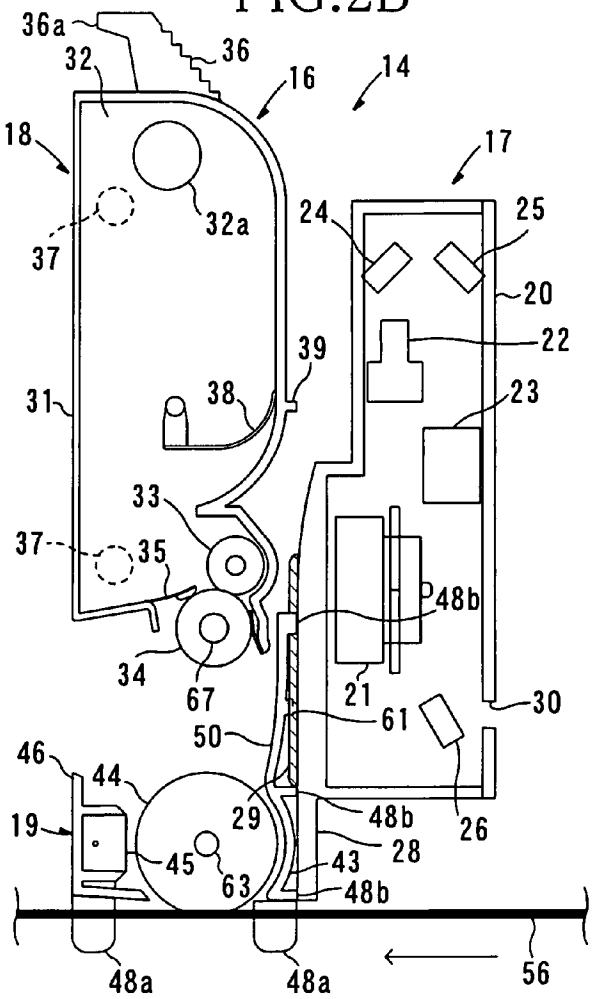
FIG. 2B is an enlarged side sectional view showing essential parts of a processing unit of the color laser printer of FIG. 1, wherein the developing unit is separated from the photosensitive drum unit with the photosensitive drum unit attached to the printer casing.
Figure 2A:
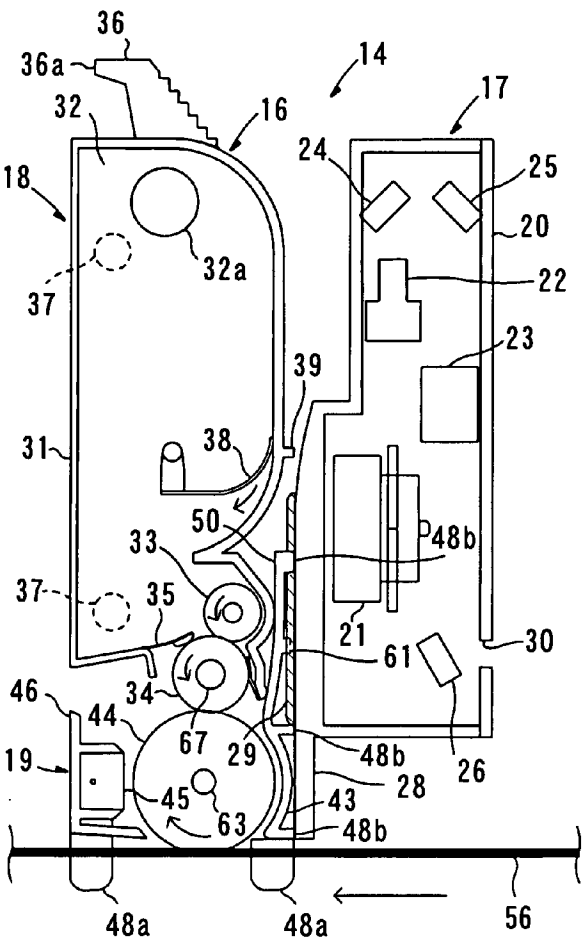
FIG. 2A is an enlarged side sectional view showing essential parts of a processing unit of the color laser printer of FIG. 1, wherein a photosensitive drum unit is mounted on a printer casing with a developing unit attached to the photosensitive drum unit.

Each of the processing portions 14 includes a scanning unit 17 as an exposing device and a processing unit 16. The scanning units 17 are fixed to the printer casing 2, at a predetermined distance away from the conveyor belt 56 in the vertical direction. Hereinafter, since all of the scanning units 17 have the same structure, only one of them will be referred to in the description below. As shown in FIG. 2A, the scanning unit 17 includes a laser emitting portion (not shown), a polygon mirror 21, two lenses 22, 23 and three reflectors 24, 25, 26 in a scanning unit casing 20 as a housing.

The scanning unit casing 20 has an elongated box shape. A scanner side guide portion 28 is integral with a rear wall of the scanning unit casing 20 in order to guide a photosensitive drum unit 19 during attachment and detachment of the photosensitive drum unit 19. The scanner side guide portion 28 extends toward the vicinity of the conveyor belt 56 from the middle of the rear wall of the scanning unit casing 20 in the vertical direction so as to gradually protrude toward the rear and proceed in the downward direction.

Figure 3A:
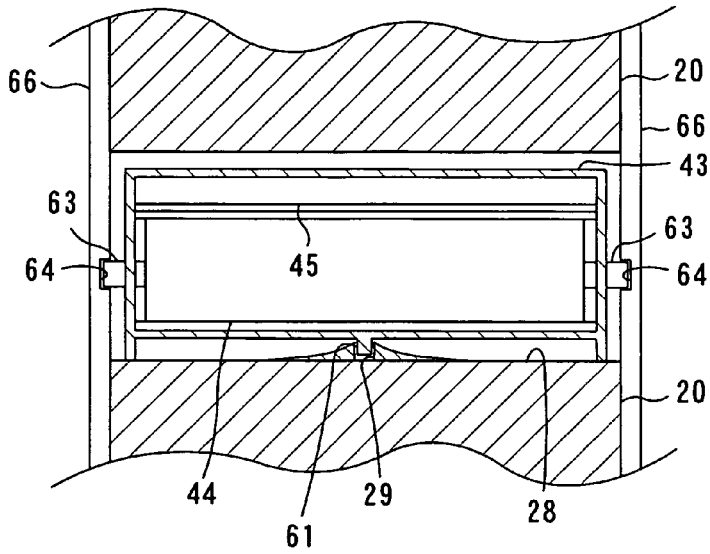
FIG. 3A is a sectional plan view showing essential parts of the photosensitive drum unit of the color laser printer of FIG. 1.

As shown in FIG. 3A, a guide groove 29 is provided in the scanner side guide portion 28 substantially at the middle of the scanner side guide portion 28 in its width direction (which is a direction perpendicular to the up and down direction when viewed from the front). The guide groove 29 extends in the up and down direction and is recessed toward the front so that a boss 61 of a cover portion 47 (FIG. 4) of a drum casing 43 (described later) is slidably engaged therewith.

As shown in FIG. 2A, a front wall of the scanning unit casing 20 has a flat surface and has a laser emitting window 30 at a portion near the lower end.

In the scanning unit 17, a laser beam (a traveling route of the laser beam is indicated by a dot-dashed line in FIG. 1), which is emitted from the laser emitting portion based on image data, is reflected off the polygon mirror 21, and then passes or is reflected off the lens 22, the reflector 24, the reflector 25, the lens 23 and the reflector 26 in this order, and finally is emitted from the laser emitting window 30. The laser beam emitted from the laser emitting window 30 is applied to the photosensitive drum 44 by a speedy scanning.

As shown in FIG. 1, the scanning units 17 are disposed substantially at the same position in the vertical direction, that is, the scanning units 17 are aligned and overlap each other when viewed from the horizontal direction. More particularly, the scanning units 17 are disposed behind the respective processing units 16. In other words, the processing units 16 and the scanning units 17 are alternately aligned and overlap each other when viewed from the horizontal direction.

Each of the processing units 16 can be attached to and detached from the printer casing 2, and includes the developing unit 18 as a developing portion and the photosensitive drum unit 19 as an image holding portion. Hereinafter, since all of the developing units 18 have the same structure, only one of them will be referred to in the description below. As shown in FIG. 2A, the developing unit 18 includes a toner hopper 32 as a developing agent storage portion, a toner supply roller 33 as a supply device, a developing roller 34 as a developing agent holding member, and a layer thickness regulating blade 35, in a developing unit casing 31.

In the developing unit 18, the developing roller 34, the toner supply roller 33 and an agitator 38, as an agitating member and a developing agent conveying device, are aligned in the vertical direction. The developing unit 18 is vertically detachably attached to the printer casing 2.

The developing unit casing 31 has a rectangular box shape with a lower open structure. A grip 36 is provided at an upper wall of the developing unit casing 31 so that the user can hold the developing unit casing 31 via the grip 36. The grip 36 upwardly protrudes from the upper wall of the developing unit casing 31 and has a triangular shape when viewed from the side. A hook portion 36*a* is integral with an upper end portion of the grip 36 so as to extend toward the side opposite to the side at which the user operates the color laser printer 1, that is, toward the rear, and the side opposite to the side where the operating panel 90 is provided, when the user opens the top cover 7 from the front.

The developing unit casing 31 is disposed so that its rear wall extends in the vertical direction. The rear wall of the developing unit casing 31 has a flat surface, parallel to the flat surface of the front wall of the scanning casing 20.

The developing unit casing 31 is disposed so that its front wall extends in the vertical direction. An upper front corner of the developing unit casing 31 is curved when viewed from the side, so as to continuously extend from the upper wall. A lower front corner of the developing unit casing 31 is also curved so as to extend toward the rear along a rotation path of the agitator 38 provided in the toner hopper 32. Further, a lower end portion of the front wall serves as a cover of the toner supply roller 33 and the developing roller 34. A second contacting portion 39 is provided at the front wall of the developing unit casing 31, near a position corresponding to the position where the agitator 38 is provided. The second contacting portion 39 protrudes toward the front and extends in the width direction of the developing unit casing 31.

Figure 4A:
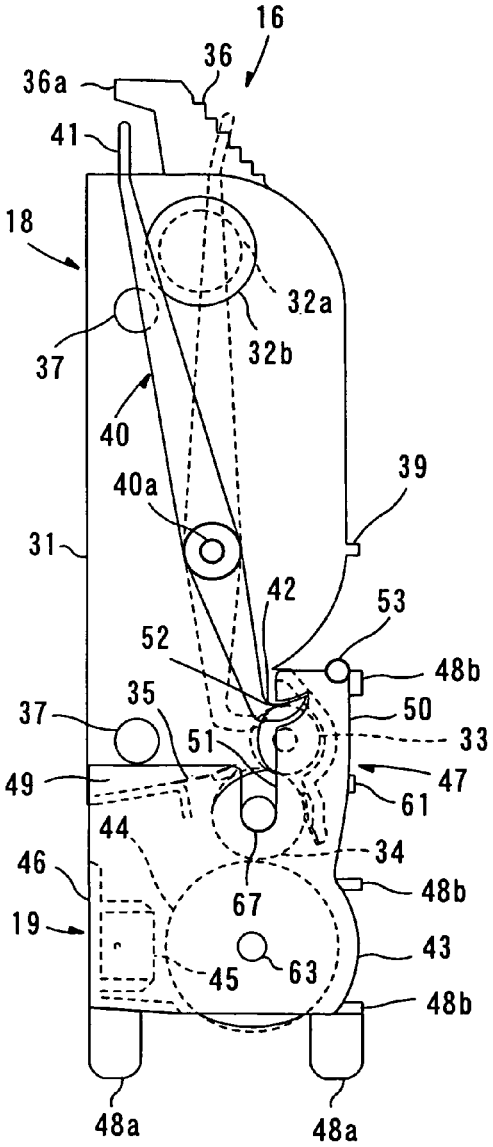
FIG. 4A is a side sectional view showing essential parts of a processing unit of the color laser printer of FIG. 1, wherein the developing unit is attached to the photosensitive drum unit.

The developing unit casing 31 is disposed so that both of the side walls in the horizontal direction extend in the vertical direction. As shown in FIG. 4A, two developer side guide protrusions 37 are provided to each of the side walls of the developing unit casing 31 (FIG. 4A shows one side of the processing unit 16 only). The developer side guide protrusions 37 are slidably engaged with printer side first guide grooves 62 (FIG. 5) provided in the printer casing 2. On each of the side walls, the developer side guide protrusions 37 outwardly protrude in the width direction, at positions distant from each other in the. vertical direction, wherein one developer side guide protrusion 37 protrudes from the position near the position corresponding to the developing roller 34 and another developer side guide protrusion 37 protrudes from the position near the upper end of the toner hopper 32. The developer side guide protrusions 37 provided at the position near the position corresponding to the developing roller 34 are provided so as to contact upper edges of side walls 49 of the photosensitive drum unit 43 when the processing unit 16 is placed in a vertical position on an installation plane 71 (FIG. 7) separated from the printer casing 2.

An engaging lever 40, extending in the up and down direction, is provided at both of the side walls of the developing unit casing 31 (FIG. 4A shows one of the engaging levers 40 only). Each of the engaging levers 40 has a flat-plate-shaped operating portion 41 at its upper end portion and a hook 42 at its lower end portion. The hooks 42 of the engaging levers 40 can engage respective engagement grooves 52 formed in the side plates 49 of a drum casing 45 (described later). The engaging levers 40 are rotatably supported by respective rotating shafts 40*a* outwardly protruding from the side walls of the developing unit casing 31 in the width direction, at the positions corresponding to the position where the agitator 38 is provided (FIG. 4 shows one of the sides of the developing unit casing 31 only). By a spring (not shown), as an urging device, provided to the developing unit casing 31, the engaging levers 40 are urged in a direction such that the hooks 42 engage the engagement grooves 52, that is, in a counterclockwise direction in FIG. 4A.

A toner filling aperture 32*a* is provided in one of the side walls of the developing unit casing 31, at the upper portion which is far from the agitator 38, in order to fill the toner hopper 32 with toner. With this structure, when filling the toner hopper 32 with toner, the toner being poured does not interfere with the agitator 38, so that the developing unit casing 31 can be excellently filled with the toner in the width direction. Accordingly, the operability of filling toner can be improved. A cap 32*b* is attached to the toner filling aperture 32*a* so as to cover the toner filling aperture 32*a*.

As shown in FIG. 2A, the toner hopper 32 is provided by an internal space of the developing unit casing 31. The toner hopper 32 includes the agitator 38 provided near the developing roller 34 and stores toner, as a developing agent, therein. That is, the yellow processing portion 14Y, the magenta processing portion 14M, the cyan processing portion 14C and the black processing portion 14K store yellow toner, magenta toner, cyan toner and black toner of a positively charging non-magnetic single component polymerized toner, respectively, in their toner hoppers 32. The polymerized toner is produced by a suspension polymerization or an emulsion polymerization, and has a substantially spherical shape and excellent fluidity.

The toner supply roller 33 is disposed below the toner hopper 32. The toner supply roller 33 includes a metal roller shaft covered with a roller portion made of a conductive sponge member. The toner supply roller 33 is supported so as to rotate in the same direction as the developing roller 34, that is, in the counterclockwise direction, at a nipping portion where the toner supply roller 33 faces the developing roller 34.

The developing roller 34 is disposed below and is in contact with the toner supply roller 33. The developing roller 34 includes a metal roller shaft 67, as a first guided portion, covered with a roller portion made of an elastic member, such as a conductive rubber material. More specifically, the roller portion of the developing roller 34 includes two layers: one layer constitutes the elastic roller portion made of a conductive elastic material, such as an urethane rubber, silicone rubber or EPDM rubber, including carbon particles, and another layer constitutes a coating layer covering the surface of the roller portion, which mainly includes an urethane rubber, urethane resin and polyimide resin, for example.

The developing roller 34 is rotatably supported such that its roller shaft 67 is supported by the portions near the lower ends of drum side guide grooves 51 (FIG. 4) of the drum casing 43 so as to rotate (counterclockwise) in the opposite direction as the rotation of the photosensitive drum 44 (clockwise) at a nipping portion where developing roller 34 opposingly contacts the photosensitive drum 44. That is, the roller shaft 67 of the developing roller 34 protrudes outwardly in the width direction from the developing casing 31 so as to slidably engage the drum side guide grooves 51. A developing bias is applied to the developing roller 34 from a power source (not shown) at the time of performing development.

The layer thickness regulating blade 35 includes a blade body made of a metal leaf spring and a pressing portion made of an insulative silicone rubber. The pressing portion having a semi-circular shape in cross section is provided at a free end of the blade body. The layer thickness regulating blade 35 is situated behind and between the toner supply roller 33 and the developing roller 34, wherein a base end of the blade body is supported by the developing unit casing 31 and the pressing portion provided at the free end of the blade body presses the upper portion of the developing roller 33 by an elastic force of the blade body.

The toner stored in the toner hopper 32 moves downward by its own weight and is supplied to the toner supply roller 33 by the agitation/rotation of the agitator 38. The toner supplied to the toner supply roller 33 is then supplied to the developing roller 34 by the rotation of the toner supply roller 33. At that time, the toner is positively charged by friction caused between the toner supply roller 33 and the developing roller 34. The toner supplied onto the developing roller 34 is further supplied between the pressing portion of the layer thickness regulating blade 35 and the developing roller 34 by the rotation of the developing roller 34, so that the toner becomes a thin layer having a uniform thickness and is held on the developing roller 34.

The developing units 18 are disposed substantially at the same level in the vertical direction, that is, the developing units 18 are aligned and overlap each other when viewed from the horizontal direction. More particularly, the developing units 18 and the scanning units 17 are alternately aligned and overlapped in the horizontal direction above the sheet feeding tray 11.

Since all of the photosensitive drum units 19 have the same structure, only one of them will be referred to in the description below. The photosensitive drum unit 19 can be attached to and detached from the printer casing 2 and includes the photosensitive drum 44 as an image holding member and the scorotron charging device 45 as a charging device.

As shown in FIGS. 2A and 4A, the drum casing 43 includes a drum accommodating portion 46 and the cover portion 47, which are integral with each other. The drum accommodating portion 46 has a rectangular shape with no upper and bottom walls. The cover portion 47, having a C shape when viewed from above, extends upward from the drum accommodating portion 46. Accordingly, the cover portion 47 does not have a rear wall.

A rear wall of the drum accommodating portion 46 has a flat plate shape which is on the same plane where the rear wall of the developing unit casing 31 extends, when the developing unit 18 and the photosensitive drum unit 19 are connected with each other. A front wall of the drum accommodating portion 46 has an arc shape in cross section, along the peripheral surface of the photosensitive drum 44. Second contacting portions 48*b*, protruding toward the front, are provided at the upper and lower ends of the front wall of the drum accommodating portion 46, i.e. four second contacting portions 48*b* are provided on the front wall of the drum accommodating portion 46.

Figure 3B:
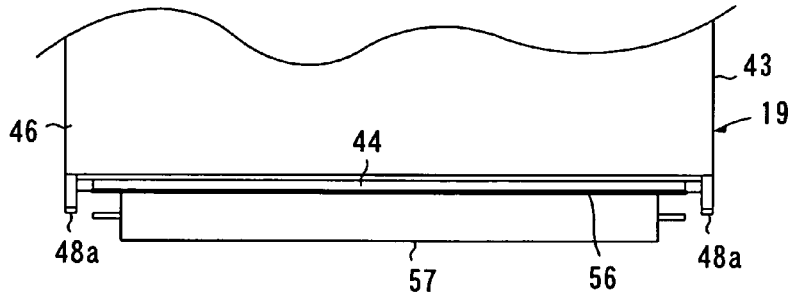
FIG. 3B is a front view showing essential parts of the photosensitive drum unit of the color laser printer of FIG. 1.

First contacting portions 48*a*, protruding downward, are provided to the bottom end portions of the front and rear walls of the drum accommodating portion 46. As shown in FIG. 3B, the first contacting portions 48*a* are provided at both side ends in the width direction of the drum accommodating portion 46, sandwiching the photosensitive drum 44, the conveyor belt 56 disposed opposite to the photosensitive drum 44, and the transfer roller 57, therebetween, such that the first contacting portions 48*a* protrudes downward more than the photosensitive drum 44. That is, four first contacting portions 48*a* are provided to the bottom end portions of the front and rear walls of the drum accommodating portion 48*a*.

As shown in FIG. 4A, the cover portion 47 is integral with the side plates 49 and a front plate 50. The side plates 49, opposite to each other, continuously extend from the respective side walls of the drum accommodating portion 46. The front plate 50 is provided between the side plates 49 and connects front ends of the side plates 49 with each other.

The side plates 49 have substantially an L-shape, wherein rear upper end portions extend in the horizontal direction and front upper end portions extend upward such that the front upper end portions are situated at a higher level than the rear upper end portions. At the middle in the front and rear direction between the front and rear portions, each of the side plates 49 is provided with a drum side guide groove 51 having an elongated U-shape and extending downward. The engagement groove 52 recessed toward the front is provided at the front portion of each of the side plates 49, at the middle of the drum side guide groove 51 in the up and down direction. In addition, each of the side plates 49 has a drum side guide protrusion 53 at the front upper end portion. The drum side guide protrusions 53, protruding outward in the width direction, are slidably engaged with respective printer side third guide grooves 65 (FIG. 5) of the printer casing 2.

The boss 61, which is slidably engaged with the guide groove 29 (FIG. 3A) of the scanner side guide portion 28 of the scanning unit 17, is provided substantially at the middle of the front plate 50 in the width direction and the up and down direction. The boss 61 protrudes toward the front. The second contacting portions 48b, protruding toward the front, are provided to both the upper end portions of the front plate 50 in the width direction of the cover portion 47. That is, two second contacting portions 48*b* are provided at the front plate 50.

The second contacting portions 48*b* provided at the drum casing 43 are designed such that their free ends are substantially on the same plane in the horizontal direction. The boss 61 protruding toward the front is shorter than the second contacting portions 48*b*.

As shown in FIG. 2, the photosensitive drum 44 includes a cylindrical metal base tube made of, for example, aluminum. The base tube is covered with a photosensitive layer of an organic photosensitive material having polycarbonate as a main component. The photosensitive drum 44 is disposed below the developing roller 34 so as to contact the developing roller 34. The photosensitive drum 44 is supported by the side walls of the drum accommodating portion 46, via the rotating shaft 63, as a guided portion, so that the photosensitive drum 44 rotates (clockwise) in the opposite direction as the conveyor belt 56 (counterclockwise) at a nipping portion of the photosensitive drum 44 and the conveyor belt 56.

Figure 5:
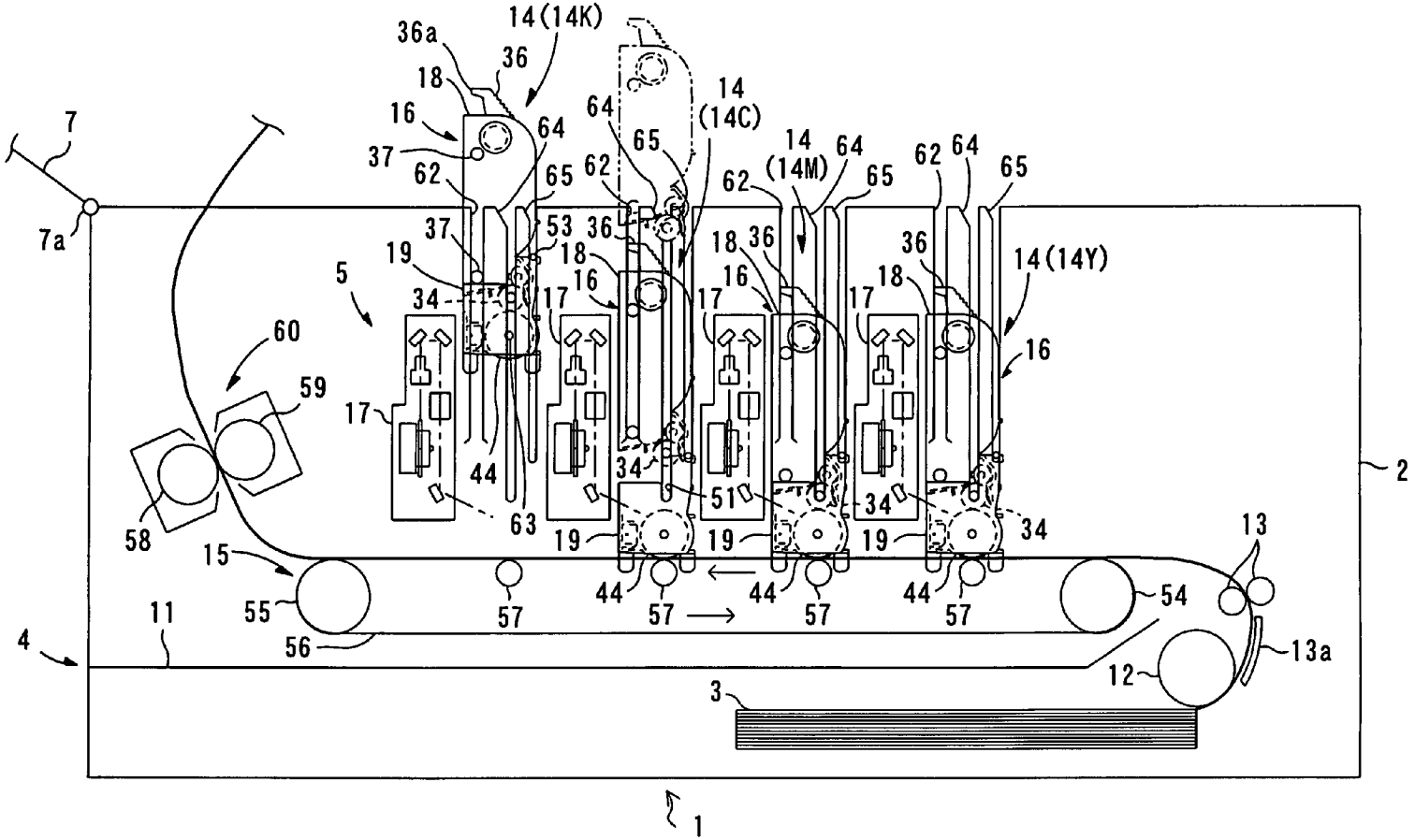
FIG. 5 is a side sectional view showing essential parts of the color laser printer of FIG. 1, wherein attaching and detaching conditions of the photosensitive drum units and the developing units with respect to the printer casing are described.

The rotating shaft 63 protrudes outward in the width direction from the side walls of the drum accommodating portion 46, and is slidably engaged with respective printer side second guide grooves 64 (FIG. 5).

The scorotron charging device 45 is disposed behind the photosensitive drum 44 and at a predetermined distance away from the photosensitive drum 44. The scorotron charging device 45 is fixed to the rear wall of the drum accommodating portion 46. The scorotron charging device 45 is a charging device that generates corona discharge from charging wires such as tungsten wires in order to positively charge the photosensitive drum 44. The scorotron charging device 45 uniformly positively charges the surface of the photosensitive drum 44 by applying voltage from the power source (not shown).

As the photosensitive drum 44 is rotated, the surface of the photosensitive drum 44 is uniformly positively charged by the scorotron charging device 45. Then, in accordance with the rotation of the photosensitive drum 44, the surface of the photosensitive drum 44 is speedily scanned by a laser beam emitted from the scanning unit 17. Thus, an electrostatic latent image is formed on the surface of the photosensitive drum 44, based on image data. Then, when the electrostatic latent image on the photosensitive drum 44 contacts the developing roller 34, the positively charged toner held on the developing roller 34 electrically moves onto and held by the electrostatic latent image formed on the photosensitive drum 44, that is, a portion whose potential is lowered by the exposure by the laser beam. Thus, the electrostatic latent image is visualized and a reversal phenomenon is achieved. By performing the above processing in each of the processing portions 14, a toner image of each color is formed on each photosensitive drum 44.

The photosensitive drum units 19 are disposed substantially at the same position in the vertical direction, that is, the photosensitive drum units 19 are aligned and overlapped in the horizontal direction. In each of the processing portions 14, the photosensitive drum unit 19 and the developing unit 18 are overlapped and aligned in the vertical direction.

More particularly, in a state where the photosensitive drum unit 19 and the developing unit 18 are attached to the printer casing 2 in each of the processing portions 14, the photosensitive drum 44, the developing roller 34, the toner supply roller 33 and the toner hopper 32 are overlapped in this order, from below, in the vertical direction, i.e. in the attaching/detaching direction of the photosensitive drum unit 19 and the developing unit 18. The photosensitive drum 44 and the scorotron charging device 45 are disposed in the vertical plane of projection of the toner hopper 32. The roller portions of the developing roller 34 and the toner supply roller 33 are disposed in the vertical plane of projection of the photosensitive drum 44.

As shown in FIG. 1, the transfer portion 15 is provided on the side opposite to the side where the developing units 18 are provided, while sandwiching the photosensitive drum 44 therebetween, in the printer casing 2. The transfer portion 15 includes a drive roller 54, a driven roller 55, the endless conveyor belt 56, and the transfer rollers 57.

The drive roller 54 is located at the front of the yellow processing portion 14Y and at the upper rear of the sheet supply roller 12. The driven roller 55 is located at the rear of the photosensitive drum 44 of the black processing portion 14K and at the lower front of the fixing portion 60.

The conveyor belt 56 is made of conductive resin, such as polycarbonate or polyimide, on which conductive particles such as carbon are dispersed. The conveyor belt 56 is wound around the drive roller 54 and the driven roller 55 such that an external contacting surface of the conveyor belt 56 opposingly contacts all of the photosensitive drums 44 of the processing portions 14.

As the driven roller 55 is driven by the driving of the drive roller 54, the conveyor belt 56 travels in the counterclockwise direction so as to rotate in the same direction of the photosensitive drums 44 with the external contacting surface contacting the photosensitive drums 44 of the processing portions 14.

The transfer rollers 57 are disposed so as to be opposite the respective photosensitive drums 44 of the processing portions 14 while sandwiching the conveyor belt 56 therebetween, in the internal area of the endless conveyor belt 56. Each of the transfer rollers 57 includes a metal roller shaft covered with an elastic member such as a conductive rubber material. The transfer rollers 57 are provided rotatably in the clockwise direction so as to rotate in the same direction as the traveling direction of the conveyor belt 56 at the contacting surfaces of the transfer rollers 57 and the conveyor belt 56.

The sheet 3 fed from the sheet feeding portion 4 passes between the conveyor belt 56, which is driven by the rotation of the drive roller 54 and driven rollers 55, and the photosensitive drums 44 of the processing portions 14. While the sheet 3 passes therebetween, the toner images formed on the photosensitive drums 44 of the processing portions 14 are transferred onto the sheet 3 one after another, whereby a color image is formed on the sheet 3.

In other words, for example, first, a yellow toner image formed onto the photosensitive drum 44 of the yellow processing portion 14Y is transferred onto the sheet 3. After that, a magenta toner image formed onto the photosensitive drum 44 of the magenta processing portion 14M is transferred onto the sheet 3 having the yellow toner image. In the same manner, a cyan toner image formed by the cyan processing portion 14C and a black toner image formed by the black processing portion 14K are transferred onto the sheet 3 having the yellow and magenta toner images. By doing so, a color image is formed on the sheet 3.

The color laser printer 1 is a tandem printer that includes the photosensitive drums 44 for the respective colors of toner. Accordingly, the color laser printer 1 can speedily form an color image by forming toner images color by color, at a speed substantially the same as a speed of forming a monochrome image.

The fixing portion 60 is disposed at the rear of the processing portions 14 and the transfer portion 15 and downstream of the transfer portion 15 in the sheet conveying direction. The fixing portion 60 includes a heat roller 59 and a pressing roller 58. The heat roller 59 includes a metal base tube covered with a removable layer, and a halogen lamp which is provided so as to extend in an axial direction of the heat roller 59. The halogen lamp heats the surface of the heat roller 59 to an appropriate temperature in order to fix the color image onto the sheet 3. The pressing roller 58 is provided so as to press the heat roller 59. The color image transferred onto the sheet 3 is thermally fixed onto the sheet 3 at the fixing portion 60 while the sheet 3 passes between the heat roller 59 and the pressing roller 58.

The sheet discharge portion 6 includes the pair of the sheet discharge rollers 8, the sheet discharge port 9 and the sheet output tray 10. The sheet 3, on which the color image is thermally fixed, is discharged from the sheet discharge port 9 to the outside by the pair of discharge rollers 8 and is stacked on the sheet output tray 10.

In the color laser printer 1, residual toner remaining on the photosensitive drum 44 after the transfer operation, is collected by the developing roller 34 in each of the processing portions 14 (i.e. so-called cleanerless developing system). In this developing system, after the transfer of the toner, the surface of the photosensitive drum 44 having residual toner is charged by the rotation of the photosensitive drum 44 at a charging position where the photosensitive drum 44 is opposite to the scorotron charging device 45, and then is exposed to light by the scanning unit 17. The residual toner which adheres to a portion that is not exposed is electrically collected by the developing roller 34 when this portion faces and contacts the developing roller 34. At the exposed portion, a toner image is formed by using the collected residual toner and the toner newly supplied to the developing roller 34.

With this structure, a waste toner storage portion is not required to store collected residual toner. Therefore, the structure of the color laser printer 1 can be simplified and the size of the developing units 18 and the photosensitive drum units 19 can be reduced since a space for the waste toner storage portion is not needed. Accordingly, the developing units 18 and the photosensitive drum units 19 can be attached to and detached from the printer casing 2 from the side opposite to the side at which the transfer portion 15 is provided, without removing the scanning units 17. In addition, if the waste toner storage portions are integrally provided in the photosensitive drum units 19, the life of the photosensitive drum units 19 is determined by a capacity of the waste toner storage portions. As a result, either of the increasing of the longevity of the photosensitive drum units 19 and downsizing of the photosensitive drum units 19 cannot be achieved. However, in the color laser printer 1 of the embodiment, both the increasing of the longevity and downsizing of the photosensitive drum units 19 can be achieved.

In this embodiment, the developing rollers 34 rotate at a peripheral speed which is 1.6 times as fast as a peripheral speed of the photosensitive drums 44. This difference in the peripheral speed makes the developing rollers 34 easier to perform the collection of residual toner on the photosensitive drums 44.

In the color laser printer 1, the compound toner, which has a sphere shape and excellent fluidity, is used, so that an excellent image can be formed on the sheet and the collection of residual toner can be effectively performed by the cleanerless developing system.

In the color laser printer 1, side plates 66 (FIG. 3A) are provided at both sides in the width direction, inside the printer casing 2. Each of the side plates 66 includes the printer side first guide grooves 62, into which the developer side guide projections 37 of the developing unit casings 31 are slidably engaged, and the printer side second guide grooves 64 and the printer side third guide grooves 65, into which the rotating shafts 63 of the photosensitive drums 44 and the drum side guide projections 53 of the drum casings 43 are engaged, respectively, as shown in FIG. 5, corresponding to the respective processing portions 14.

The printer side first guide grooves 62 are provided in the side plates 66 such that the developing unit casings 31 are disposed in front of the respective scanning casings 20, in parallel to each other, at a predetermined distance away from each other. The upper ends of the printer side first guide grooves 62 are open when the top cover 7 opens. The lower ends of the printer side first guide grooves 62 are also open at the position where the developer side lower guide protrusions 37 of the developing unit casings 31 are positioned when the roller shafts 67 of the developing rollers 34 are positioned at the front end opened portions (that is, the guide starting positions) of the drum side guide grooves 51 of the drum casings 51. The portions between the upper ends and the lower ends of the printer side first guide grooves 62 extend in the vertical direction.

The printer side second guide grooves 64 are provided in front of the respective printer side first guide grooves 62, in parallel to each other, at a predetermined distance away from each other (FIG. 3A). The printer side second guide grooves 64 are provided in the right and left side plates 66 so as to be opposite to each other. The upper ends of the printer side second guide grooves 64 are open when the top cover 7 opens. The lower ends of the printer side second guide grooves 64 are closed and have substantially a U-shape in cross section, at a position where the rotating shafts 63 of the photosensitive drums 44 are positioned when the photosensitive drums 44 are disposed so as to contact the conveyor belt 56. The portions between the upper ends and the lower ends of the printer side second guide grooves 64 extend in the vertical direction.

The printer side third guide grooves 65 are provided in front of the respective printer side second guide grooves 64, in parallel to each other, at a predetermined distance away from each other. The printer side third guide grooves 65 are provided in the right and left side plates 66 so as to be opposite to each other (FIG. 3A). The upper ends of the printer side third guide grooves 65 are open when the top cover 7 opens. The lower ends of the printer side third guide grooves 65 have substantially a U-shape in cross section so that the drum side guide protrusions 53 of the drum casings 43 do not abut against the lower ends when the rotating shafts 63 of the photosensitive drum 44 abut against the lower ends of the printer side second guide grooves 64.

In the color laser printer 1, the developing units 18 can be attached to and detached from the respective photosensitive drum units 19. The developing unit 18 and the photosensitive drum unit 19 can be integrally attached to and detached from the printer casing 2. In addition, the developing unit 18 can be attached to and detached from the respective photosensitive drum unit 19 with the photosensitive drum unit 19 being fixed to the printer casing 2.

Figure 4B:
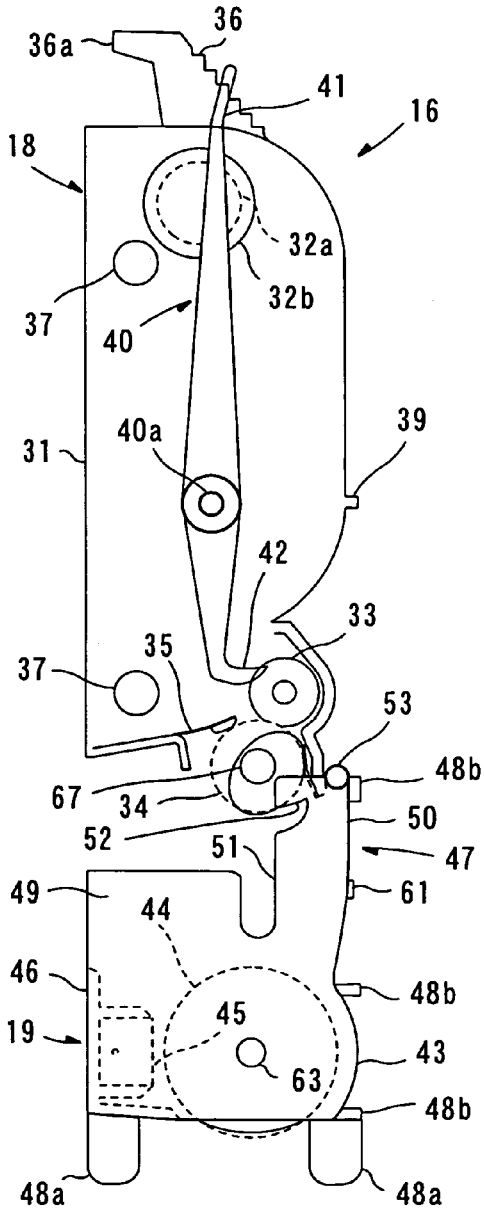
FIG. 4B is a side sectional view showing essential parts of the processing unit of the color laser printer of FIG. 1, wherein the developing unit is separated from the photosensitive drum unit.

The attaching and detaching operation of the developing unit 18 with respect to the photosensitive drum unit 19 will be described below with reference to FIG. 4. First, the attaching operation of the developing unit 18 to the photosensitive drum unit 19 in a state where the processing unit 16 is separated from the printer casing 2 will be described below. First, from the condition shown in FIG. 4B, the user moves the operating portions 41 of the engaging levers 40 forward against the urging force from the spring in order to move the hooks 42 toward the rear by rotating the engaging levers 40. Then, the user downwardly inserts the developing unit 18 into the photosensitive drum unit 19. As shown in FIG. 4A, the roller shaft 67 of the developing roller 34 is inserted into the drum side guide grooves 51 of the drum casing 43 until the roller shaft 67 reaches the lower ends of the drum side guide grooves 51. After that, as the user releases his/her hand from the operating portions 41, the operating portions 41 rotate backward by the urging force from the spring. Thus, the hooks 42 of the engaging levers 40 are engaged with the respective engagement grooves 52 of the drum casing 43, whereby the developing unit 18 is attached to the photosensitive drum unit 19 with the developing roller 34 contacting the photosensitive drum 44.

The engagement grooves 52 are designed such that the developing unit 18 can move in the up and down direction with respect to the photosensitive drum unit 19, for example, by approximately 1 mm, while the engagement grooves 52 are engaged with the hooks 42. More specifically, the hooks 42 have a size such that the hooks 42 can move in the up and down direction by approximately 1 mm with respect to the engagement grooves 52. The drum side guide grooves 51 are designed such that the roller shaft 67 of the developing roller 34 can freely move in the lower ends of the drum side guide grooves 51.

The detaching operation of the developing unit 18 from the photosensitive drum unit 19 in a state where the processing unit 16 is separated from the printer casing 2 will be described below. First, in the state shown in FIG. 4A, the user moves the operating portions 41 of the engaging levers 42 forward against the urging force from the spring in order to disengage the hooks 42 from the engagement grooves 52 by rotating the engaging levers 40. After that, the user upwardly pulls and removes the developing unit 18 from the photosensitive drum unit 19. By doing so, as shown in FIG. 4B, the roller shaft 67 of the developing roller 34 is withdrawn from the drum side guide grooves 51. Then, the roller shaft 67 of the developing roller 34 is pulled out of the drum side guide grooves 51, and thus, the developing unit 18 is separated from the photosensitive drum unit 19.

As described above, the attaching and detaching operations of the developing unit 18 with respect to the photosensitive drum unit 19 can be achieved by the engagement and disengagement of the hooks 42 of the engaging levers 40 provided at the developing unit casing 31 with respect to the engagement grooves 52 of the drum casing 43. In the attaching and detaching operation above, the engagement and disengagement of the hooks 42 with respect to the engagement grooves 52 can be achieved by operating the operating portions 41 of the engaging levers 40 of the developing unit casing 31. That is, the attaching and detaching operation of the developing unit 18 with respect to the photosensitive drum unit 19 can be performed from above. Accordingly, the attaching and detaching operation can be facilitated and its operability can be improved.

Next, the integral attaching operation of the developing unit 18 and the photosensitive drum unit 19 with respect to the printer casing 2 will be described below. As shown in FIG. 5, for example, first, the user opens the top cover 7. Then, referring to the black processing portion 14K, in the state where the developing unit 18 is integrated with the photosensitive drum unit 19, the user slides the integrated photosensitive drum unit 19 and developing unit 18 downward until the rotating shaft 63 of the photosensitive drum 44 abuts against the respective lower ends of the printer side second guide grooves 64 by holding the grip 36. The user slides the integrated photosensitive drum unit 19 and developing unit 18 via the upper opening of the printer casing 2 defined by the opened top cover 7, while the developer side guide protrusions 37 of the developing unit casing 31 are engaged with the printer side first guide grooves 62, the rotating shaft 63 of the photosensitive drum 44 is engaged with the printer side second guide grooves 64, and the drum side guide protrusion 53 of the drum casing 43 is engaged with the printer side third guide grooves 65.

By doing so, the developer side guide protrusions 37 of the developing unit casing 31, the rotating shaft 63 of the photosensitive drum 44, and the drum side guide protrusion 53 of the drum casing 43 are guided downward in the vertical direction by the printer side first, second, and third guide grooves 62, 63, 64, respectively. When the drum casing 43 is opposite to the scanner side guide portion 28 of the scanning unit casing 20, the drum casing 43 is guided by the scanner side guide portion 28. When the boss 61 of the cover portion 47 of the drum casing 43 is opposite to the scanner side guide portion 28, the boss 61 is engaged with the guide groove 29 of the scanner side guide portion 28, whereby the boss 61 is guided by the guide groove 29 (FIGS. 2A and 2B). Then, the rotating shaft 63 of the photosensitive drum 44 abuts against the lower ends of the printer side second guide grooves 64, so that the photosensitive drum 44 contacts the conveyor belt 56 and the developing unit 18 and the photosensitive drum unit 19 are integrally attached to the printer casing 2.

Figure 6:
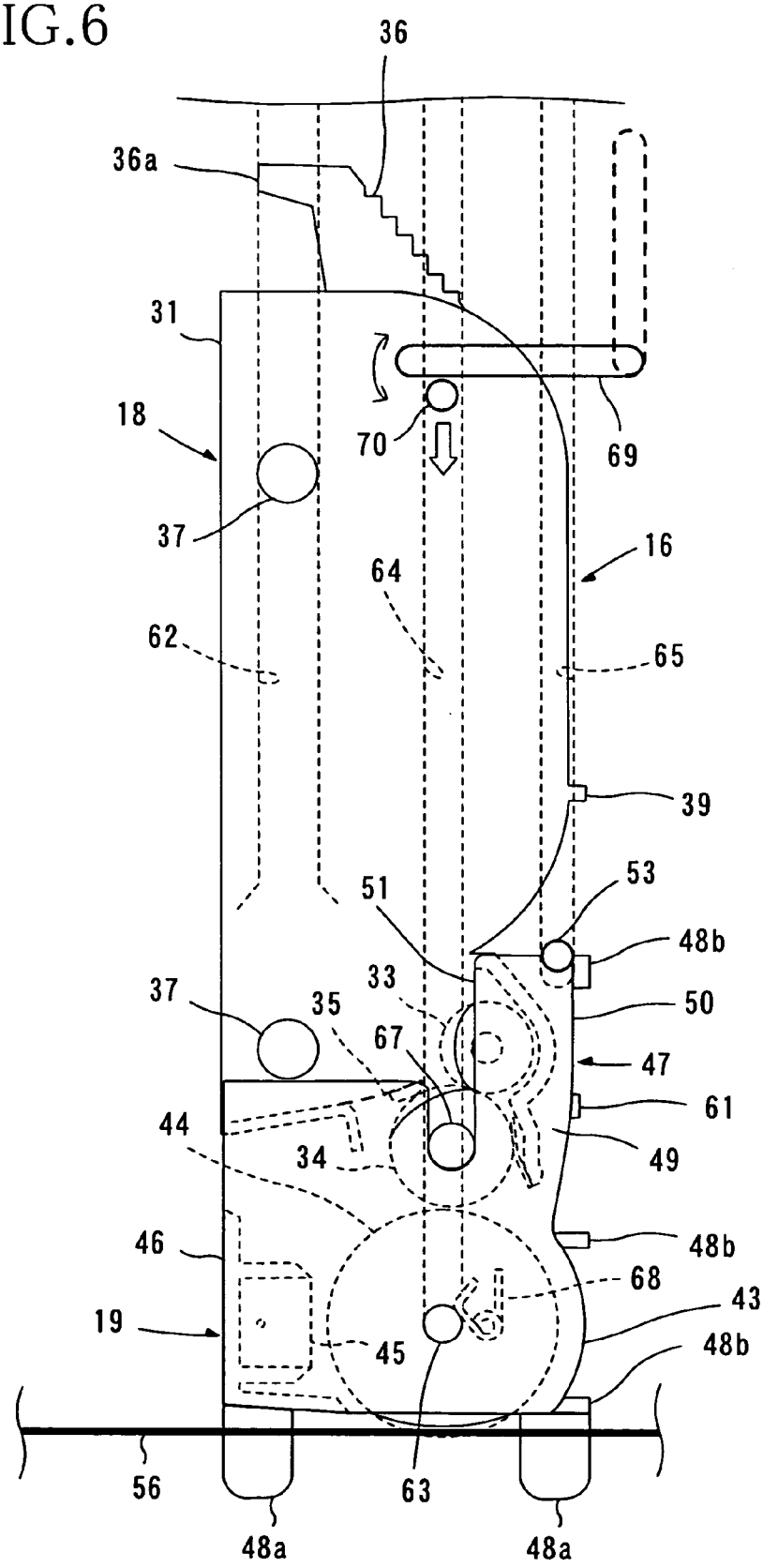
FIG. 6 is an enlarged side sectional view showing essential parts of the color laser printer of FIG. 5, wherein the photosensitive drum unit and the developing unit are attached to the printer casing.
Figure 9A:
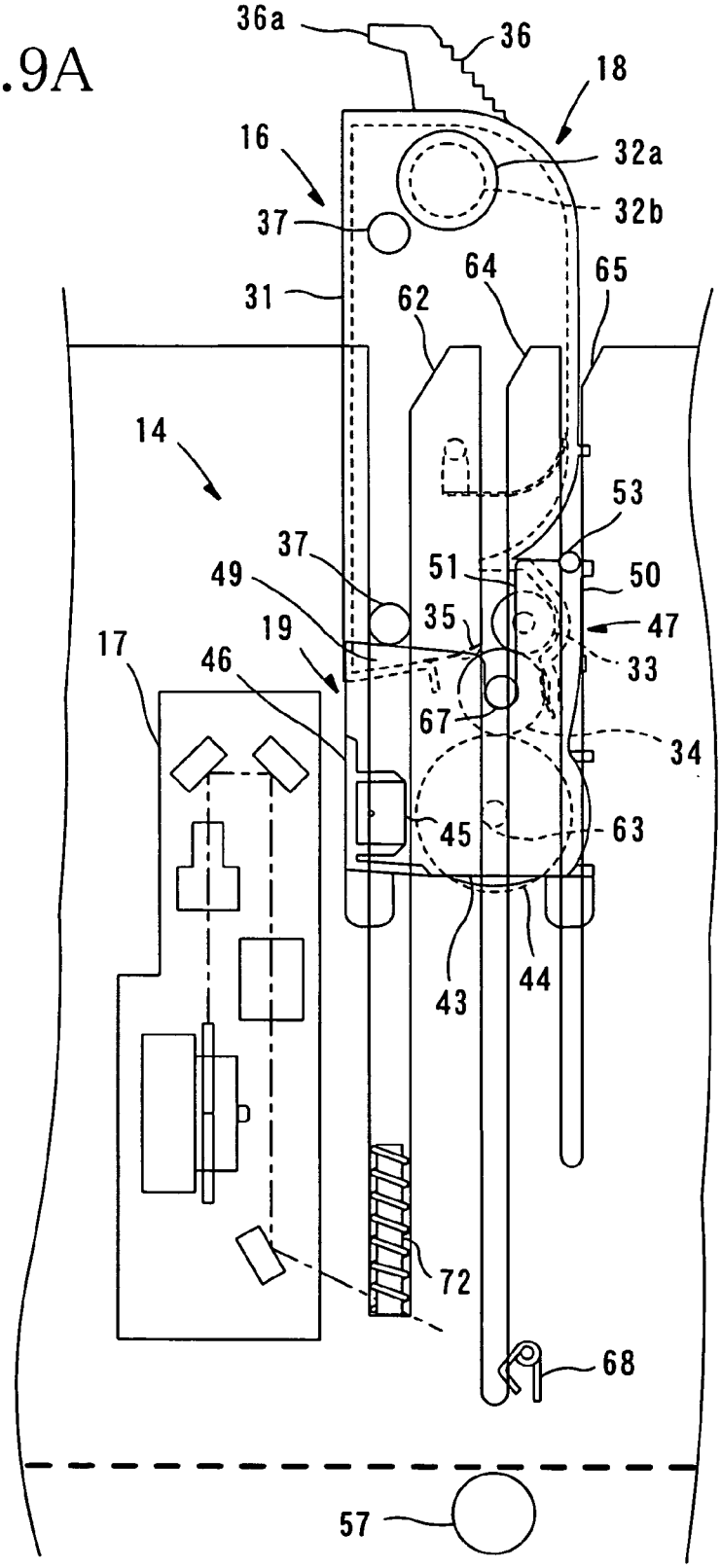
FIG. 9A is a side sectional view showing essential parts of the color laser printer of FIG. 1 with a spring in a lower end portion of a printer side first guide groove, wherein the developing unit is being guided downward.
Figure 9B:
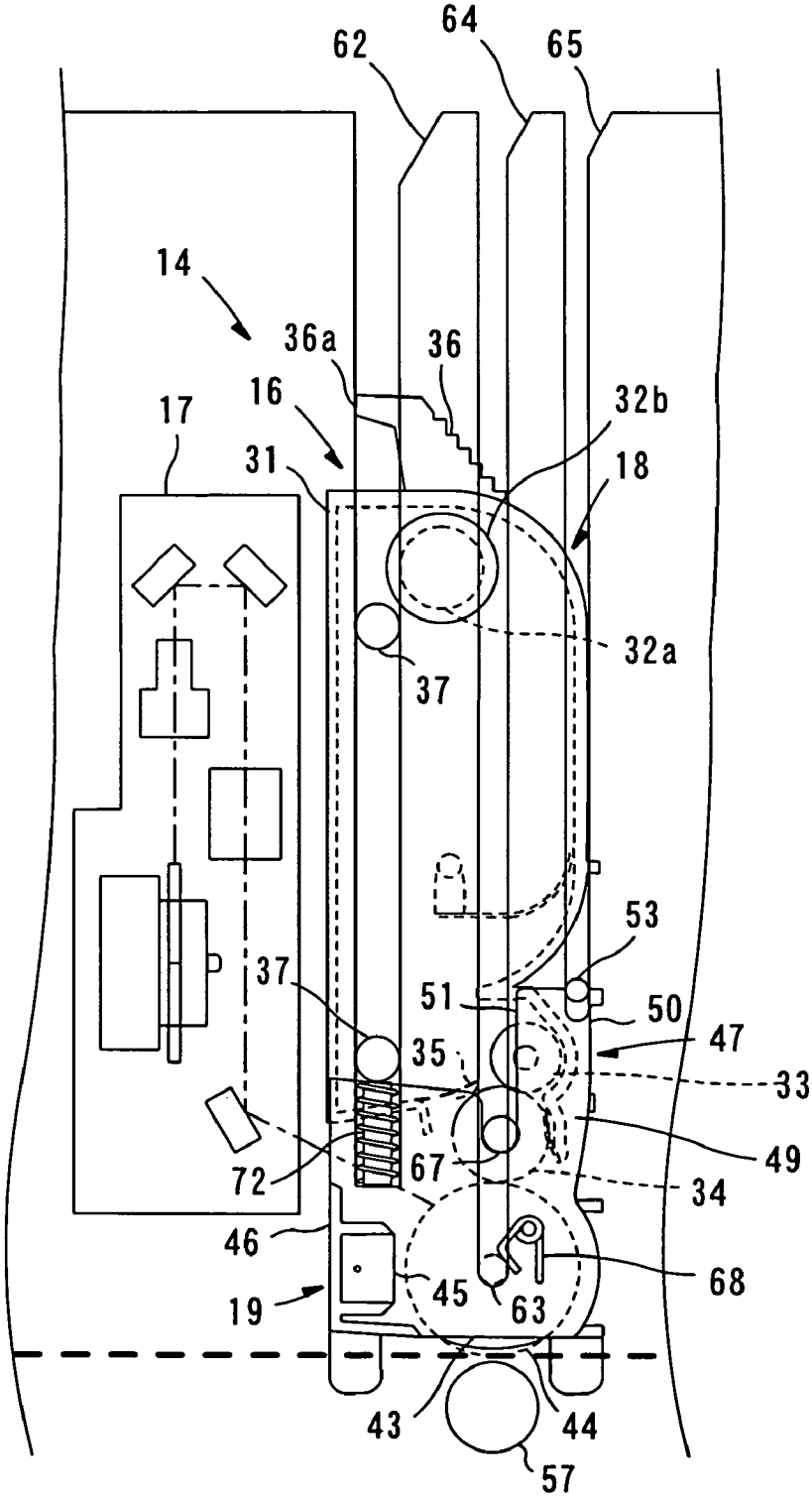
FIG. 9B is a side sectional view showing essential parts of the color laser printer of FIG. 1 with the spring in the lower end portion of the printer side first guide groove, wherein a developer side lower guide protrusion of the developing unit is elastically received by the spring.

When the developing unit 18 and the photosensitive drum unit 19 are integrally attached to the printer casing 2 as described above, the rotating shaft 63 of the photosensitive drum 44 elastically contacts pressing springs 68, as cushioning members, provided to the lower end portions of the printer side second guide grooves 64 of the printer casing 2 before abutting against the lower end portions of the printer side second guide grooves 64, and then the rotating shaft 63 overpasses the pressing springs 68 (FIGS. 6, 9A and 9B). In the state where the rotating shaft 63 of the photosensitive drum 44 abuts against the lower ends of the printer side second guide grooves 64 of the printer casing 2, the pressing springs 68 press the rotating shaft 63 downward. With this structure, the photosensitive drum 44 can be positioned so as to contact the conveyor belt 56.

The printer casing 2 is provided with a pressing lever 69 (FIG. 6) so as to be able to downwardly press contact shafts 70 (FIG. 6) protruding sideways in the width direction from the upper portion of the developing unit casing 31.

The pressing lever 69 moves between a retracted position indicated by a dashed line and a pressing position indicated by a solid line, by a motor (not shown). When the photosensitive drum 44 rotates, the pressing lever 69 is positioned at the pressing position. When the photosensitive drum 44 stops rotating, the pressing lever 69 is positioned at the retracted position. Accordingly, the developing roller 34 can be positioned so as to surely contact the photosensitive drum 44. The movement of the pressing lever 69 can be synchronized with the opening and closing operation of the top cover 7, instead of the driving of the motor.

Next, the integral detaching operation of the photosensitive drum unit 19 and the developing unit 18 from the printer casing 2 will be described below. As shown in FIG. 5, first, the user opens the top cover 7. Then, the user slides the integrated photosensitive drum 19 and the developing unit 18 upward via the upper opening of the printer casing 2 defined by the opened top cover 7 by holding the grip 36.

Then, the rotating shaft 63 of the photosensitive drum 44 is moved upward against the pressing force from the pressing spring 68 by overpassing the pressing spring 68, and the boss 61 is guided upward in the vertical direction by the guide groove 29 of the scanner side guide portion 28. The developer side guide protrusions 37 of the developing unit casing 31, the rotating shaft 63 of the photosensitive drum 44, and the drum side guide protrusion 53 of the drum casing 43 are also guided upward in the vertical direction, so that the integrated photosensitive drum unit 19 and developing unit 18 are pulled out of the printer casing 2, whereby the photosensitive drum unit 19 and the developing unit 18 are integrally separated from the printer casing 2.

The attaching and detaching operation of the developing unit 18 with respect to the photosensitive drum unit 19 with the photosensitive drum unit 19 attached to the printer casing 2 will be described with reference to the cyan processing portion 14C shown in FIG. 5.

When separating the developing unit 18 from the photosensitive drum unit 19 with the photosensitive unit 19 attached to the printer casing 2, first, the user opens the top cover 7. Then, as described above, in the state shown in FIG. 4A, the user moves the operating portions 41 of the engaging levers 40 of the developing unit casing 31 toward the front to disengage the hooks 42 from the engagement grooves 52, via the upper opening of the printer casing 2 defined by the opened top cover 7. After that, the user pulls the developing unit 18 upward by holding the grip 36.

Then, the engagement of the developing unit 18 and the photosensitive drum unit 19 is released, and as shown in FIG. 5, the roller shaft 67 of the developing roller 34 is pulled out of the drum side guide grooves 51 of the drum casing 43, whereby the developing unit 18 is separated from the photosensitive drum unit 19. Next, the developer side guide protrusions 37 of the developing unit casing 31 are guided upward in the vertical direction by the printer side first guide grooves 62, so that the developing unit 18 is pulled out of the photosensitive unit 19. Thus, only the developing unit 18 can be removed from the printer casing 2.

When attaching the developing unit 18 to the photosensitive drum 19 that is fixed to the printer casing 2, first, the user opens the top cover 7. Then, the user slides the developing unit 18 downward by holding the grip 36, via the upper opening of the printer casing 2 defined by the opened top cover 7, with the developer side guide protrusions 37 of the developing unit casing 31 engaged with the printer side first guide grooves 62.

By doing so, the developer side guide protrusions 37 of the developing unit casing 31 are guided downward in the vertical direction by the printer side first guide grooves 62. When the developer side guide protrusions 37 are guided to the lower ends of the printer side first guide grooves 62, as shown in FIG. 4B, the roller shaft 67 of the developing roller 34 is engaged with the drum side guide grooves 51 of the drum casing 43 at the lower ends of the printer side first guide grooves 62. Then, the developing unit casing 31, being guided by the printer casing 2, is passed to the drum casing 43 and then the roller shaft 67 is guided by the drum side guide grooves 51.

After that, at the position before the roller shaft 67 of the developing roller 34 reaches the lower end portions of the drum side guide grooves 51, the hooks 42, which are urged toward the front by the urging force from the springs, contact the upper edges of the side plates 49 of the drum casing 43. Then, the user moves the operating portions 41 toward the front to position the hooks 42 at the rear position. In this state, the user slides the developing unit 18 downward until the roller shaft 67 of the developing roller 34 reaches the lower end portions of the drum side guide grooves 51. When the user then releases his/her hand from the operating portions 41 at the position where the roller shaft 67 of the developing roller 34 is located in the lower end positions of the drum side guide grooves 51, the hooks 42 are engaged with the respective engagement grooves 52 of the drum casing 43, by the urging force from the springs. Thus, the developing unit 18 is attached to the photosensitive drum unit 19 while the developing roller 34 opposingly contacts the photosensitive drum 44, as shown in FIG. 4A.

In the color laser printer 1 described above, the processing units 16 and the scanning units 17 are alternately aligned in the horizontal direction and overlap each other when viewed in the horizontal direction. Therefore, the developing units 18 and the photosensitive drum units 19 of the respective processing units 16 can be attached to and detached from the printer casing 2 via the upper opening of the printer casing 2 defined by the opened top cover 7, without removing the scanning units 17. In addition, in the state where the photosensitive drum units 19 and the developing units 18 are attached to the printer casing 2, in each of the processing units 16, the photosensitive drum 44, the developing roller 34, the toner supply roller 33, and the toner hopper 32 are overlapped in this order, from below, in the vertical direction, i.e. in the attaching and detaching direction of the photosensitive drum units 19 and the developing units 18. The photosensitive drum 44 and the scorotron charging device 45 are disposed in the vertical plane of projection of the toner hopper 32. The roller portion of the developing roller 34 and the roller portion of the toner supply roller 33 are disposed with the vertical plane of projection of the photosensitive drum 44.

Accordingly, the scanning units 17 fixed to the printer casing 2 do not interfere with the developing units 18 and the photosensitive drum units 19 of the processing units 16, so that the developing units 18 and the photosensitive drum units 19 can be smoothly attached to and detached from the printer casing 2. Since the scanning units 17 are not moved, that is, the scanning units 17 are fixed to the printer casing 2, when attaching or detaching the processing units 16, the adequate accuracy of the exposure to the photosensitive drums 44 can be assured.

Because the processing units 16 are disposed as described above, the thickness of the processing units 16 in the front and rear direction can be reduced. Therefore, the installation space for the processing units 16 in the horizontal direction can be saved.

In the color laser printer 1, each set of the developing unit 18 and the photosensitive drum unit 19 can be integrally attached to and detached from the printer casing 2. In addition, the developing units 18 can be attached to and detached from the respective photosensitive drum units 19 while the photosensitive drum units 19 are fixed to the printer casing 2.

Accordingly, when the toner hopper 32 of the developing unit 18 is empty of toner, the developing unit 18 can be replaced with a new one by separating the developing unit 18 from the photosensitive drum unit 19 while the photosensitive drum unit 19 is fixed to the printer casing 2. Thus, only the developing unit 18 having a high replacing frequency can be changed. As a result, the running cost and industrial waste can be reduced. Furthermore, the changing operation of the developing unit 18 can be facilitated.

In the tandem color laser printer 1 having the photosensitive drums 44 for each color of toner, toner particles of each color are transferred, one after another, onto the sheet 3, by each photosensitive drum 44. Accordingly, the accuracy of positioning of the photosensitive drums 44 is required in order to prevent toner particles transfer deviation between each of the colors. Thus, the unnecessary attaching and detaching operation of the photosensitive drums 44 should be avoided.

To prevent the transfer deviation, in the state where the photosensitive drum unit 19 is fixed to the printer casing 2, the developing unit 18 is replaced with a new one with respect to the photosensitive drum unit 19. By doing so, only the developing unit 18 can be changed without detaching the photosensitive drum 44 from the printer body 2. Accordingly, each of the photosensitive drums 44 can be prevented from deviating from the positions, thereby forming a color image having a high image quality with less deviation.

When the photosensitive drum 44 is replaced with a new one, as described above, the developing unit 18 and the photosensitive drum unit 19 are integrally removed from the printer case 2. Then, the used developing unit 18 is separated from the photosensitive drum unit 19. After that, a new developing unit 18 is attached to the photosensitive drum unit 19, and then, the integrated developing unit 18 and photosensitive drum unit 19 are attached to the printer casing 2. Thus, the photosensitive drum unit 19 having a low replacing frequency can be changed with a new one.

During the attaching and detaching operation, the developer side guide protrusions 37 of the developing unit 18 are guided in the vertical direction by the printer side first guide grooves 62, so that the attaching and detaching operation of the developing unit 18 with respect to the printer casing 2 can be assured. Further, the rotating shaft 63 of the photosensitive drum 44 and the drum side guide protrusion 53 of the drum casing 43 are also guided in the vertical direction by the printer side second guide grooves 64 and the printer side third guide grooves 65, respectively. Accordingly, the attaching and detaching operation of the photosensitive drum unit 19 can be assured.

The printer side first, second, and third guide grooves 62, 64, 65, are provided in parallel with each other so as to be opposite to the surfaces of the longer sides of the respective scanner casings 31 of the scanning units 17. Therefore, the developing unit 18 can be detached singly or in combination with the photosensitive drum unit 19 from between the scanning units 17.

In addition, the printer side first, second and third guide grooves 62, 64, 65 are provided in the opposing side plates 66 provided on both sides of the developing units 18 in the width direction (on the both sides in the axial direction of the developing roller 34) so as to face each other. Accordingly, the developing units 18 and the photosensitive drum units 19 can be guided with a simple structure when the detaching operation of the developing unit 18 and the photosensitive drum unit 19 from the printer casing 2 is performed.

The developing unit 18 is provided with the two developer side guide protrusions 37 at the vertically separated positions, on each side. By engaging the developer side guide protrusions 37 with the printer side guide grooves 62, the developing unit 18 can be guided therein while the developing unit 18 is prevented from rattling or moving in the horizontal direction. Accordingly, even if the developing unit 18 has longer surfaces in the vertical direction, the developing unit 18 can be stably attached to and detached from the printer casing 2.

In the photosensitive drum unit 19, the boss 61 of the cover portion 47 is guided by the guide groove 29 of the scanner side guide portion 28 of the scanning unit casing 20, so that the photosensitive drum unit 19 can be stably attached to and detached from the printer casing 2. Further, because the scanner side guide portion 28 for guiding the boss 61 is integral with the scanning unit casing 20, that is, the surface of the scanning unit casing 20 also serves as a guide member of the developing unit 18, the photosensitive drum unit 19 can be stably attached to and detached from the printer casing 2 while a parts count can be reduced and the structure of the color laser printer 1 can be simplified.

In the color laser printer 1, when the developing unit 18 is attached to the photosensitive drum unit 19, the roller shaft 67 of the developing roller 34 is guided by the drum side guide grooves 51 of the photosensitive drum unit 19 so that the developing roller 34 becomes opposite to the photosensitive drum 44. Accordingly, the high accuracy of positioning the photosensitive drum 44 with respect to the developing roller 34 and an excellent color image can be achieved.

Further, even when the photosensitive drum unit 19 is fixed to the printer casing 2, the developing roller 34 can be disposed with the high accuracy of positioning with respect to the photosensitive drum 44 because the developing unit 18 is attached to the photosensitive drum unit 19 that is fixed to the printer casing 2, as described below. First, the roller shaft 67 of the developing roller 34 is guided to the guide start position where the roller shaft 67 is started to be guided by the drum side guide grooves 51, with the developer side guide protrusions 37 being engaged with the printer side first guide grooves 62. Then, the developer side guide protrusions 37 are disengaged from the printer side guide grooves 62 and the roller shaft 67 of the developing roller 34 is engaged with the drum side guide grooves 51, whereby the developing roller 34 is guided to the position to opposingly contact the photosensitive drum 44.

In the attaching and detaching operation described above, the developing unit 18 can be smoothly attached and detached singly or in combination with the photosensitive drum unit 19, to and from the printer casing 2, by which the user holds the grip 36, which protrudes upward than the scanning unit 17 and is provided to the developing unit 18. Accordingly, the operability of the developing unit 18 can be improved. In particular, because the upper end portion of the grip 36 is provided with the hook portion 36a extending rearward, the user can hold the grip 36 by reaching and catching the hook portion 36*a* extending to the side opposite to the front, from the front. Thus, the user can firmly hold the grip 36 of the developing unit 18.

In the color laser printer 1, the scanning units 17 and the processing units 16 are alternately aligned in the horizontal direction and overlap each other when viewed from the horizontal direction and the size of the color laser printer 1 is reduced. With this structure, however, gaps between the scanning units 17 and the processing units 16 become small, so that the user cannot hold or grab the housings of the processing units 16. However, as described above, the grips 36 are provided with the processing units 16. With this structure, the space for the user to hold the processing units 16 can be provided and the user can easily hold the processing units 16 via the grips 36.

In the developing unit 18, the front wall, the rear wall and the side walls of the developing unit casing 31 extend in the vertical direction. With this structure, the toner particles, which are stored in the toner hopper 32 and contact the front wall, the rear wall and the side walls of the toner hopper 32, can be excellently moved in the direction of gravity. Accordingly, the toner particles can be smoothly supplied to the toner supply roller 33 and the developing roller 34 from the toner hopper 32.

In this embodiment, the developing unit casing 31 is designed such that its front wall, rear wall and side walls extend in the vertical direction when the developing unit 18 is attached to the printer casing 2. However, the developing unit casing 31 may be designed such that each wall is inclined toward the interior portion of the toner hopper 32 and toward an upper portion of the toner hopper 32. However, the wall should not be inclined toward the exterior portion of the toner hopper 32 and toward an upper portion of the toner hopper 32. If the developing unit casing 31 is designed such that each wall is inclined toward the exterior, it is difficult for the user to attach the developing unit 18 to the printer casing 2.

In the developing unit 18, the toner particles moving in the direction of gravity from the toner hopper 32 can be excellently agitated and supplied to the toner supply roller 33 and the developing roller 34 by using the agitator 38 provided near the developing roller 34 in the toner hopper 32.

In the color laser printer 1, the toner particles stored in the toner hopper 32 are supplied to the toner supply roller 33, provided at the lower portion in the direction of gravity, by their own weight, in the developing unit 18. Therefore, another agitator 38 is not required to be separately provided at the upper portion of the toner hopper 32. That is, only one agitator 38 is provided near the developing roller 34 and the toner particles stored in the toner hopper 32 can be supplied to the toner supply roller 33 while being circulated in the toner hopper 32.

Figure 7:
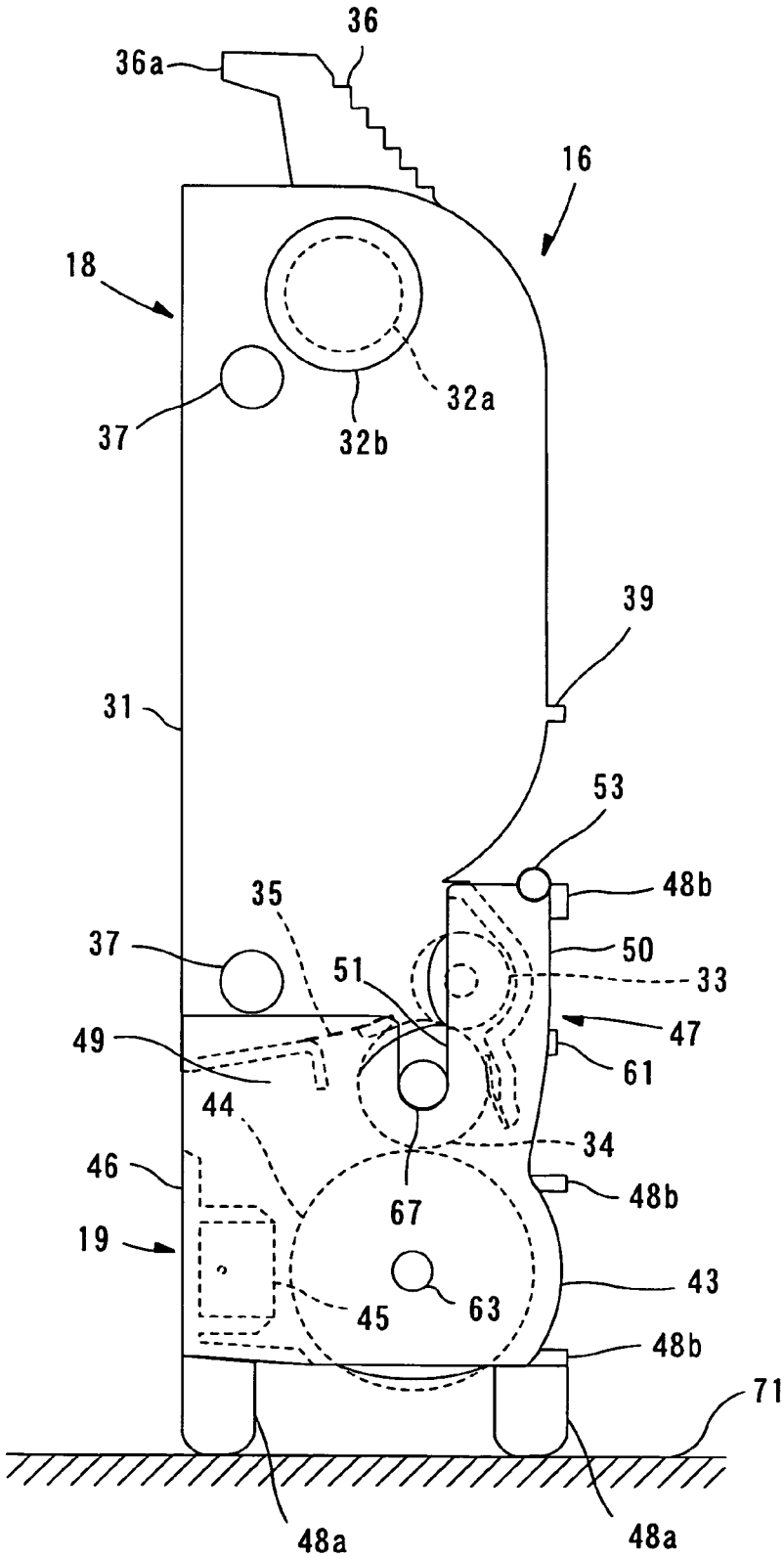
FIG. 7 is a side sectional view showing essential parts of the processing unit of the color laser printer of FIG. 1, with the processing unit placed on an installation plane in a vertical position.

As shown in FIG. 7, the processing unit 16 in which the developing unit 18 is attached to the photosensitive drum unit 19 can be stably placed in the vertical position (in a state where the photosensitive drum 44 and the developing roller 34 are aligned in the vertical direction) by contacting the first contacting portions 48*a* of the drum casing 43 with respect to the installation plane 71, in a state where the processing unit 16 is separated from the printer casing 2. In this state, the developer side lower guide protrusions 37 are in contact with the upper edges of the side plates 49 of the photosensitive drum unit 43.

Figure 8:
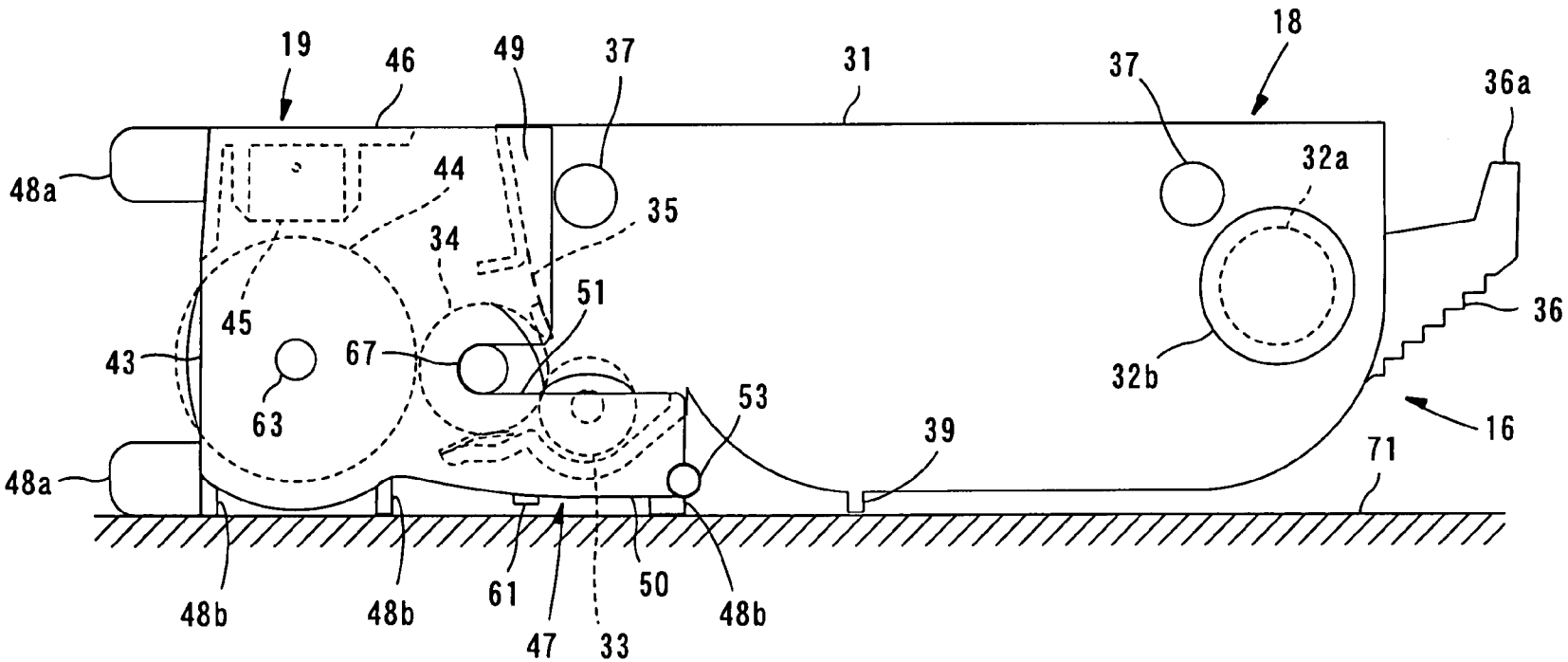
FIG. 8 is a side sectional view showing essential parts of the processing unit of the color laser printer of FIG. 1, with the processing unit placed on the installation plane in a horizontal position.

As shown in FIG. 8, the processing unit 16 in which the developing unit 18 is attached to the photosensitive drum 19 can be stably placed in the horizontal position (in a state where the photosensitive drum 44 and the developing roller 34 are aligned in the horizontal direction) by contacting the second contacting portions 48*b* of the drum casing 43 and the second contacting portion 39 of the developing unit casing 31 with respect to the installation plane 71, in the state where the processing unit 16 is separated from the printer casing 2.

In other words, the processing unit 16 of the color laser printer 1 can be stably placed on the installation plane 71, both in the vertical position and in the horizontal position, by selectively contacting the first contacting portions 48*a* and the second contacting portions 39, 48*b*, in the state where the processing unit 16 is separated from the printer casing 2. Accordingly, in both the installation positions, the toppling of the processing unit 16 can be prevented and the handling of the processing unit 16 can be simplified.

As shown in FIGS. 9A and 9B, the lower ends of the printer side first guide grooves 62 can be closed and springs 72 may be provided in the lower ends of the printer side first guide grooves 62. In this case, the width of the printer side first guide grooves 62 are slightly widened in the horizontal direction and the printer side first guide grooves 62 are extended to the position which is lower than the position where the developer side lower guide protrusions 37 of the developing unit 18 are situated in the state in which the developing unit 18 is attached to the printer casing 2. The springs 72 function as cushioning members to receive the developer side lower guide protrusions 37 of the developing unit 18.

With this structure, even if the user accidentally releases his/her hand from the grip 36 in a process of guiding the developing unit 18 downward as shown in FIG. 9A to attach the developing unit 18 to the printer casing 2 and thus the developing unit 18 drops by its own weight, the developing unit 18 can be elastically received by the springs 72 via the developer side lower guide protrusions 37. Accordingly, the collision between the developing roller 34 and the photosensitive drum 44 can be absorbed, thereby preventing damage to the developing roller 34 and the photosensitive drum 44.

In FIGS. 9A and 9B, the pressing springs 68 (FIG. 6) are also provided at the lower end portions of the printer side second guide grooves 64, so that the rotating shaft 63 of the photosensitive drum 44 can be elastically received by the pressing springs 68. Therefore, the collision between the rotating shaft 63 of the photosensitive drum 44 and the transfer roller 57 can be absorbed, thereby preventing damage to the rotating shaft 63 and the transfer roller 57.

Figure 10:
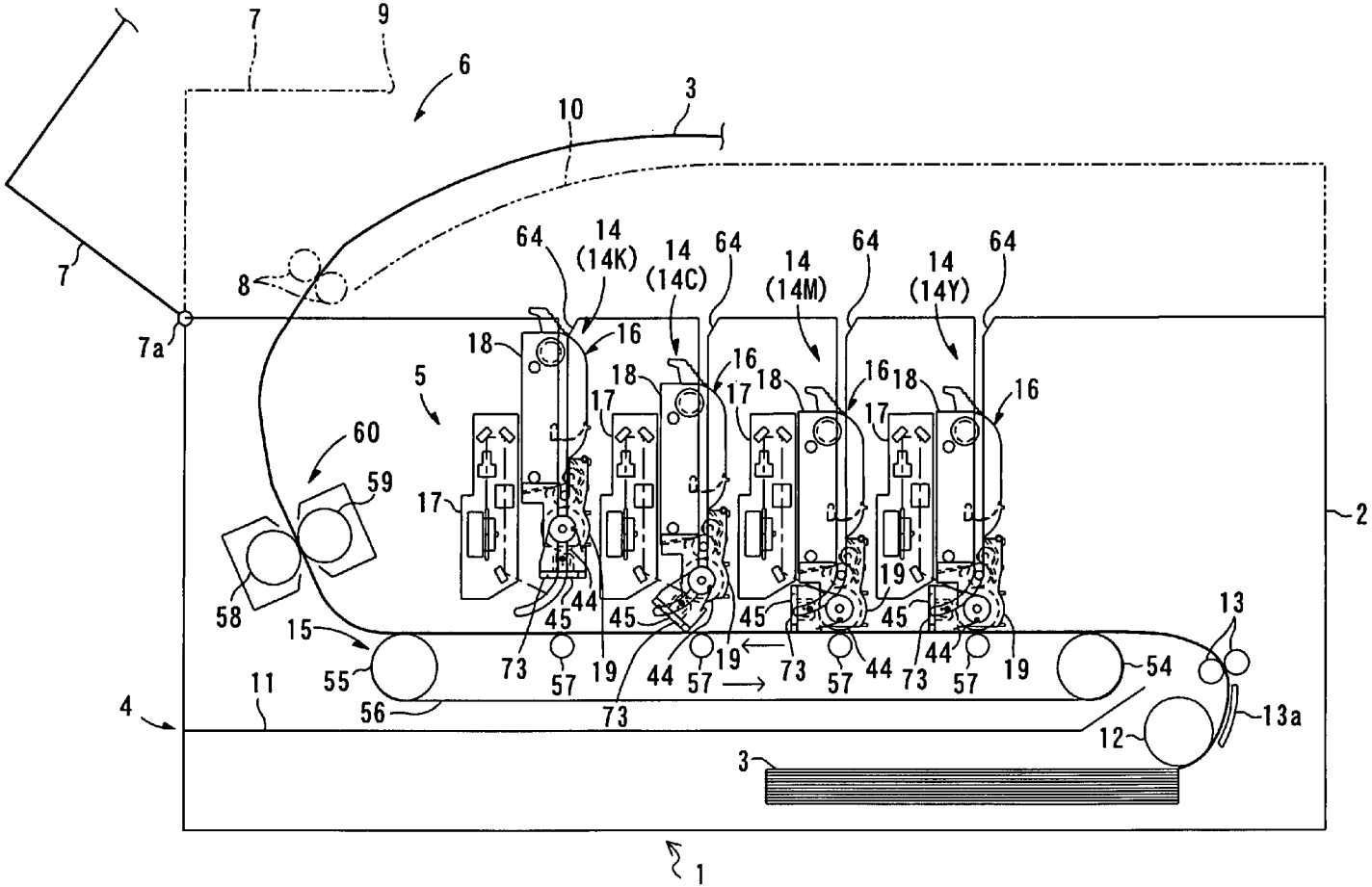
FIG. 10 is a side sectional view showing essential parts of the color laser printer of FIG. 1, wherein a structure capable of moving a scorotron charging device between a first position and a second position is described.

In the above description, the scorotron charging device 45 is fixed to the rear wall of the drum accommodating portion 46 of the photosensitive drum unit 19. However, as shown in FIG. 10, the scorotron charging device 45 can be provided so as to be movable between a first position where the scorotron charging device 45 faces the photosensitive drum 44 in the vertical direction and a second position where the scorotron charging device 45 faces the photosensitive drum 44 in the horizontal direction. In other words, as shown in FIG. 10, the drum accommodating portion 46 does not have a rear wall. However, the drum accommodating portion 46 has a charging device cover 73 that is rotatable and fixedly holds the scorotron charging device 45.

Figure 11:
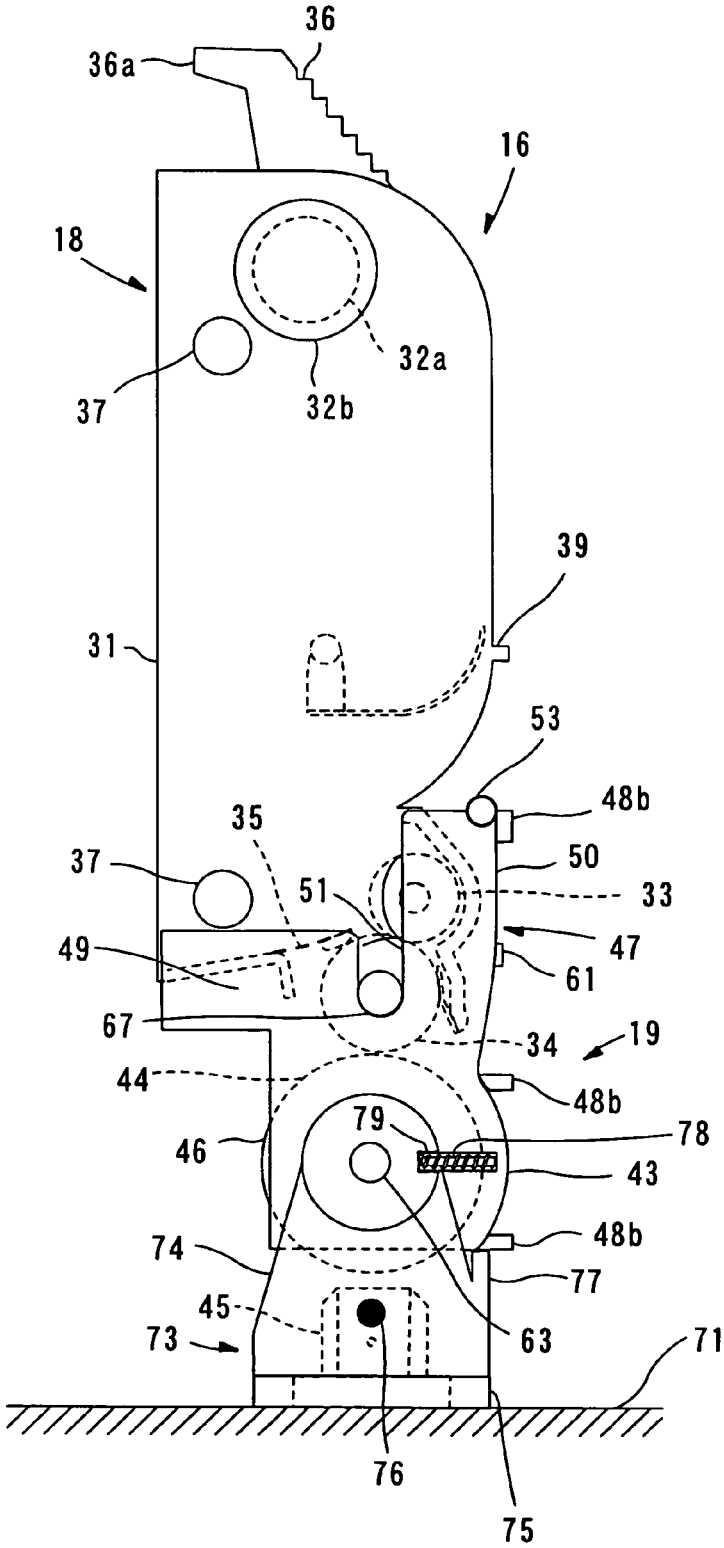
FIG. 11 is a side sectional view showing essential parts of a processing unit of the color laser printer of FIG. 10, wherein the processing unit is placed on an installation plane in a vertical position.

As shown in FIG. 11, the C-shaped charging device cover 73 has a width which is larger than the width of the drum accommodating portion 46. The charging device cover 73 includes side plates 74, each of whose one end is connected to the rotating shaft 63 so as to be rotatable relative to the rotating shaft 63 and which has a triangular shape in cross section. The charging device cover 73 also includes a rectangular support plate 75, which is integral with the cover side plates 74 so as to extend between the side plates 74. On the surface of the support plate 75 opposite to the photosensitive drum 44, the scorotron charging device 45 is fixedly provided. With this structure, the support plate 75 can rotate about the rotating shaft 63 of the photosensitive drum 44 via the side plates 74, while the scorotron charging device 45 is fixed to the support plate 75 and the scorotron charging device 45 is opposite to the photosensitive drum 44 at a predetermined distance away from each other.

The side plate 74 is provided with a guide pin 76, which protrudes outward in the width direction and is engageable with the printer side second guide groove 64 of the printer casing 2, at a position opposite to the scorotron charging device 45. The other side plate 74 is also provided with the guide pin 76 in a manner similar to the above. A foot portion 77 is provided to each of the side plates 74. The foot portions 77 contact the bottom of the drum accommodating portion 46 when the scorotron charging device 45 is positioned at the first position.

As shown in FIG. 10, the printer side second guide grooves 64 of the printer casing 2 are curved so as to extend toward the rear to the fixing positions of the scorotron charging device 45.

With this structure, the processing units 16 are attached to the printer body 2 as described below. The explanation will be given with reference to the black processing portion 14K of the processing unit 16 in FIG. 10. First, in the state where the scorotron charging device 45 is located at the first position, the guide pins 76 and the rotating shaft 63 of the photosensitive drum 44 are serially engaged with the printer side second guide grooves 64, at the attaching position of the processing unit 16 to the printer casing 2. After that, the processing unit 16 is slid downward in the similar manner to the operation described above. Then, referring to the cyan processing portion 14C of the processing unit 16, the charging device cover 73 is rotated rearward (in the clockwise direction) by the guiding of the guide pins 76 when the guide pins 76 reach the curved portions of the printer side second guide grooves 64, and thus, the charging device cover 73 is rotated rearward by 90 degrees about the rotating shaft 63. When the processing unit 16 is completely attached to the printer casing 2, the charging device cover 73 is oriented in the horizontal position, so that the scorotron charging device 45 is positioned at the second position where the scorotron charging device 45 faces the photosensitive drum 44 in the horizontal direction. The scorotron charging device 45 and the scanning unit 17 are disposed so as to overlap one another when viewed from the vertical direction.

When the processing unit 16 is removed from the printer casing 2, the reverse operation, that is, the processing unit 16 is slid upward in the manner similar to the above operation. Then, the charging device cover 73 is rotated toward the front (in the counterclockwise direction) by approximately 90 degrees about the rotating shaft 63 by the guiding of the guide pins 76. Therefore, the scorotron charging device 45 is positioned at the first position where the scorotron charging device 45 faces the photosensitive drum 44 in the vertical direction. Then, the processing unit 16 is pulled upward and removed from the printer casing 2.

As described above, the scorotron charging device 45 is moved between the first position and the second position. The scorotron charging device 45 is positioned at the first position when the processing unit 16 is attached to and detached from the printer casing 2. Accordingly, the processing unit 16 can be attached to and detached from the printer casing 2 without the scorotron charging device 45 interfering with the scanning unit 17. In the state where the processing unit 16 is completely attached to the printer casing 2, the scorotron charging device 45 is positioned at the second position where the scorotron charging device 45 faces to the scanning unit 17 in the horizontal direction. Therefore, the scorotron charging device 45 and the scanning unit 17 overlap one another when viewed from the vertical direction, while the photosensitive drum 44 is located at the transfer position. Thus, the color laser printer 1 can be downsized in the horizontal direction.

In the state where the processing unit 16 is separated from the printer casing 2, the scorotron charging device 45 is positioned at the first position. As shown in FIG. 11, the processing unit 16 can be situated in the vertical position by contacting the support plate 75 of the charging device cover 73 fixedly having the scorotron charging device 45 thereon to the installation plane 71 in the above state. That is, when the scorotron charging device 45 is located at the first position, the charging device cover 73 can also serve as a first contacting portion, so that a parts count can be reduced and the structure of the color laser printer 1 can be simplified.

In the state where the processing unit 16 is placed in the vertical position, the foot portions 77 of the side plates 74 contact the lower edges of the drum accommodating portion 46.

The drum accommodating portion 46 is provided with a rotation preventing spring 78 (FIG. 11) that urges one end of the side plates 74, relatively rotatably connected to the rotating shaft 63. The one end of the drum accommodating portion 46 is provided with receiving grooves 79 (FIG. 11) that receive the rotation preventing spring 78. When the processing unit 16 is placed in the vertical position, the rotation preventing spring 78 is received in the receiving grooves 79. With this structure, the rotation of the side plates 74 about the rotating shaft 63 is regulated.

Because the foot portions 77 contact the lower edges of the drum accommodating portion 46 and the rotation of the side plates 77 is regulated by the engagement of the rotation preventing spring 78 and the receiving grooves 79, the processing unit 16 can be stably placed in the vertical position.

In the description above, the tandem color laser printer 1 of the horizontal installation type has been described as an image forming apparatus of the invention. However, the image forming apparatus of the invention may be a tandem color laser printer 1 of a vertical installation type in which four processing portions 14 are aligned in the vertical direction as shown in FIG. 12.

Figure 12:
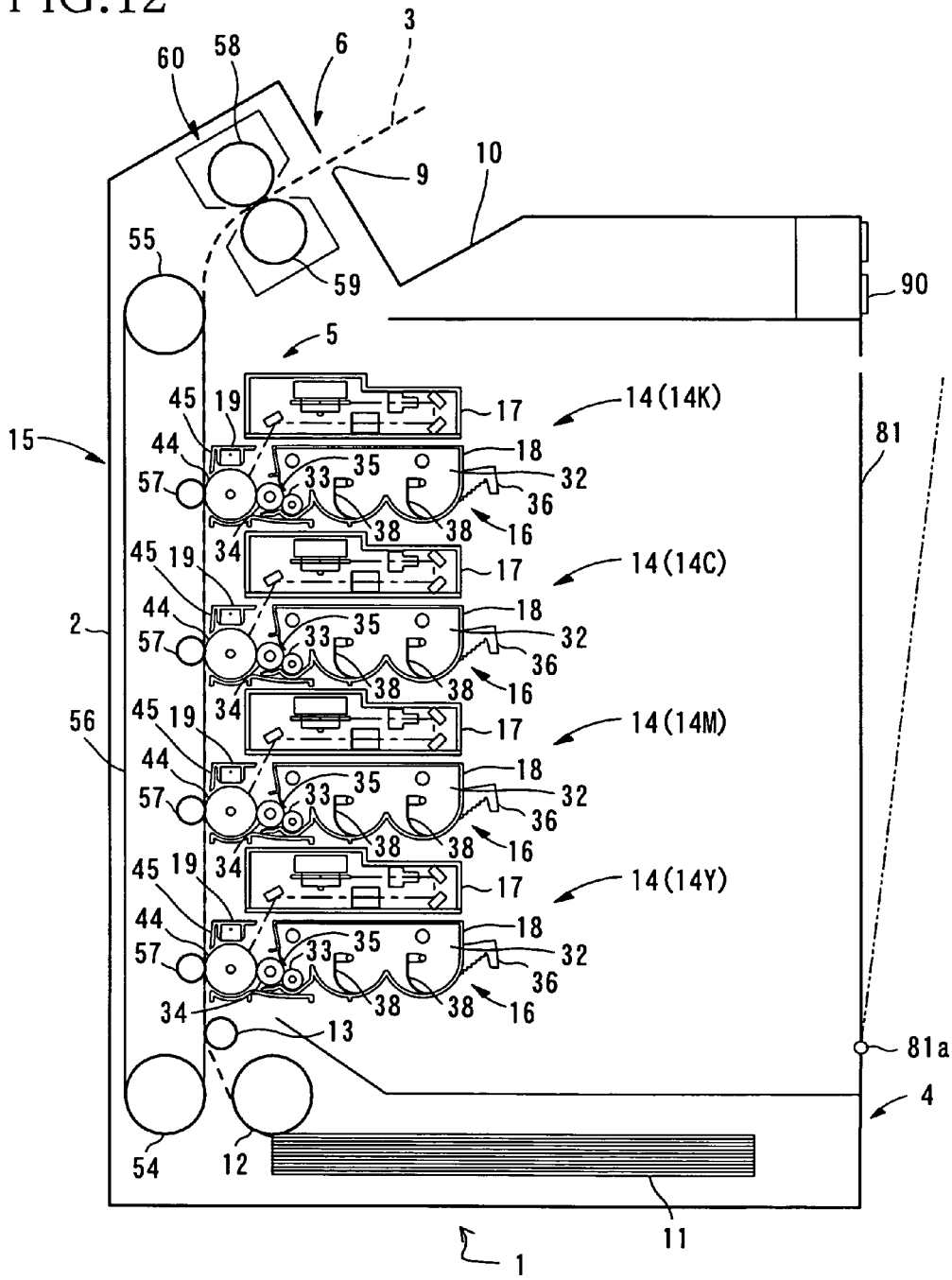
FIG. 12 is side sectional view showing essential parts of a color laser printer (a vertical installation type) as an image forming apparatus of the invention.

The color laser printer 1 of FIG. 12 basically has the same structure as the color laser printer 1 of the horizontal installation type described above. The only difference between the color laser printers 1 is the installed orientation, that is, the color laser printer 1 of FIG. 12 is a vertical installation type printer. Thus, the same parts are designated with the similar numerals and explanations for those parts will be omitted.

In FIG. 12, the color laser printer 1 of this type includes a front cover 81 provided to the front of a printer casing 2, instead of the top cover 7. The front cover 81 is disposed on the side opposite to a transfer position in which photosensitive drums 44 contact a conveyor belt 56 in a transfer portion 15. The front cover 81 is rotatably supported by a hinge 81*a* provided to the front of the printer casing 2 so as to open and close with respect to the printer casing 2 as shown in double dashed chain line.

A sheet feeding portion 4 is provided at the bottom of the printer casing 2. A sheet discharge portion 6 is provided at the upper portion of the printer casing 2 (but sheet discharge rollers 8 are not provided). An image forming portion 5 includes processing portions 14, the transfer portion 15 and a fixing portion 60.

The processing portions 14 include a yellow processing portion 14Y, a magenta processing portion 14M, a cyan processing portion 14C and a black processing portion 14K, which are aligned, in this order from below, in the vertical direction, at a predetermined distance away from each other and overlap each other when viewed from the vertical direction. The processing portion 14 includes a scanning unit 17 and a processing unit 16. The scanning units 17 and the processing units 16 are alternately aligned and overlapped in the vertical direction.

The scanning units 17 are fixed to the printer casing 2. The processing unit 16 is designed such that the developing unit 18 and the photosensitive drum unit 19 are integrally attached to and detached from the printer casing 2 in the horizontal direction. In addition, only the developing unit 18 can be attached to and detached from the photosensitive drum unit 19 in the horizontal direction while the photosensitive drum unit 19 is fixed to the printer casing 2. Although not shown in FIG. 12, the color laser printer 1 of FIG. 12 is also provided with a guide member to attach and detach the developing unit 18 and the photosensitive drum unit 19 to and from the printer casing 2.

In the processing unit 16, the photosensitive drum 44, a developing roller 34, a toner supply roller 33 and a toner hopper 32 are provided in this order from the rear so as to overlap each other when viewed in the horizontal direction. The photosensitive drum 44 and the scorotron charging device 45 are disposed in the horizontal plane of projection of the toner hopper 32, and the developing roller 34 and the toner supply roller 33 are disposed in the horizontal plane of projection of the photosensitive drum 44.

The toner hopper 32 of the developing unit 18 includes two agitators 38, which are provided at a predetermined distance away from each other in the, horizontal direction.

The transfer portion 15 is provided so as to extend opposite to the photosensitive drums 44 aligned in the vertical direction, while sandwiching the photosensitive drums 44 with the respective developing units 18 therebetween. The fixing portion 60 is provided above the transfer portion 15.

In the color laser printer 1 of the vertical installation type of FIG. 12, the processing units 16 and the scanning units 17 are also alternately aligned in the vertical direction. Therefore, the developing units 18 and the photosensitive drum units 19 of the processing units 16 can be attached to and detached from the printer casing 2 via the front opening of the printer casing 2 defined by the opened front cover 81, without removing the scanning units 17. In the state where the photosensitive drum unit 19 and the developing unit 18 are attached to the printer casing 2, the photosensitive drum 44, the developing roller 34, the toner supply roller 33 and the toner hopper 32 are disposed in this order from the rear so as to overlap in the horizontal direction. The photosensitive drum 44 and the scorotron charging device 45 are disposed in the horizontal plane of projection of the toner hopper 32, and the roller portions of the developing roller 34 and the toner supply roller 33 are disposed in the horizontal plane of projection of the photosensitive drum 44.

With this structure, the developing units 18 and the photosensitive drum units 19 of the processing units 16 can be smoothly attached to and detached from the printer casing 2 without being interfered by the scanning units 17 fixed to the printer casing 2. Further, the scanning units 17 are fixed to the printer casing 2 when the processing units 16 are attached and detached, so that the adequate accuracy of the exposure to the photosensitive drums 44 can be assured.

Because the processing units 16 are disposed as described above, the thickness of the processing units 16 in the up and down direction can be reduced. Therefore, the size of the color laser printer 1 can be reduced in the vertical direction.

In the above description, as the exposing device, the scanning unit 17 including a laser beam scanner is used. However, for example, an LED array may be used instead of the scanning unit 17.

In the processing unit 16, the developing unit 18 is designed so as to be attachable and detachable with respect to the photosensitive drum unit 19. However, the developing unit 18 and the photosensitive drum unit 19 can be integrated so as not to be separated from each other.

In the description above, the tandem color laser printers 1 of the direct transfer type that directly transfers toner images onto a sheet 3 has been described. However, the image forming apparatus of the invention is not limited to the direct transfer type printers 1, but is also applied to a tandem color laser printer 1 of an intermediate transfer type that transfers a toner image of each color onto an intermediate transfer body and then transfers the toner images onto a sheet at one time, for example.

While the invention has been described in detail with reference to the specific embodiments thereof, it would be apparent to those skilled in the art that various changes, arrangements and modifications may be applied therein without departing from the spirit and scope of the invention.

What is claimed is:

1. An image forming apparatus, comprising:

processing units for respective colors of developing agents each of which can be attached to and detached from an image forming apparatus body, the processing units including:

a developing portion that includes a developing agent storage chamber that stores developing agent therein and a developing agent holding member that holds the developing agent; and an image holding portion that includes an image holding member that holds a developing agent image that is formed by development of an electrostatic latent image by the developing agent held by the developing agent holding member, wherein the developing portion and the image holding portion can be attached to and detached from the image forming apparatus body in a state where the developing portion and the image holding portion are integrated with each other, and the developing portion can be attached to and detached from the image holding portion;

exposing devices for the respective colors of the developing agents, each of which is fixed to the image forming apparatus body and scans a laser beam to the image holding member in order to form the electrostatic latent image onto the image holding member; and a cover member that is provided on a side opposite to a transfer position where the developing agent image held by the image holding member is transferred and that opens and closes with respect to the image forming apparatus body, wherein:

the processing units and the exposing devices are alternately disposed, and the processing units are attached to and detached from the image forming apparatus body via an opening defined by the cover member that is opened with respect to the image forming apparatus body; and the image holding portion includes a first guiding portion that guides the developing portion so that the developing agent holding member faces the image holding member, and the developing portion includes a first guided portion that is guided by the first guiding portion.

2. The image forming apparatus according to claim 1, wherein the developing agent holding member is provided above the image holding member and the developing agent storage chamber is provided above the developing agent holding member in a state where the processing unit is attached to the image forming apparatus body.

3. The image forming apparatus according to claim 2, wherein a wall of the developing agent storage portion, extending in the processing unit attaching and detaching direction, extends substantially in a vertical direction or is inclined inwardly upward of the developing agent storage portion when the processing unit is attached to the image forming apparatus body.

4. The image forming apparatus according to claim 2, wherein an agitator that agitates the developing agent is provided in the developing agent storage portion, at a position near the developing agent holding member.

5. The image forming apparatus according to claim 1, wherein the developing portion can be attached to and detached from the image holding portion in a state where the image holding portion is fixed to the image forming apparatus body.

6. The image forming apparatus according to claim 1, wherein the image holding portion includes an engagement portion and the developing portion includes an engaging portion engageable with the engagement portion.

7. The image forming apparatus according to claim 6, wherein the developing portion includes an operating portion in order to release the engaging portion from the engagement portion.

8. The image forming apparatus according to claim 1, wherein the image forming apparatus body includes a second guiding portion that guides the attachment and detachment of the developing portion with respect to the image forming apparatus body.

9. The image forming apparatus according to claim 1, wherein the developing portion includes a second guided portion, and the second guiding portion guides the second guided portion of the developing portion so that the first guided portion of the developing portion is guided to a guide start position of the image holding portion attached to the image forming apparatus body.

10. The image forming apparatus according to claim 8, wherein the image forming apparatus body includes a third guiding portion that guides the attachment and detachment of the image holding portion with respect to the image forming apparatus body.

11. The image forming apparatus according to claim 10, wherein the second guiding portion and the third guiding portion are provided so as to be opposite to a surface of a casing of the exposing device, and are substantially in parallel with each other.

12. The image forming apparatus according to claim 10, wherein a surface of a casing of the exposing device serves as a guide member of the image holding portion.

13. The image forming apparatus according to claim 10, wherein the second guiding portion and the third guiding portion are provided in sides of the image forming apparatus body, in axial directions of the developing portion and the developing agent holding member, so as to be opposite to the respective second guiding portion and the third guiding portion.

14. The image forming apparatus according to claim 10, wherein a cushioning member that receives a received portion of the second guided portion of the developing portion or a received portion of the image holding portion is provided in at least one of a deepest recess of the second guiding portion and a deepest recess of the third guiding portion.

15. The image forming apparatus according to claim 1, wherein the processing unit includes a grip to be held by a user.

16. The image forming apparatus according to claim 15, further comprising an operating panel to be operated by the user, wherein the grip includes a hook extending toward a side opposite to a side where the operating panel is provided.

17. The image forming apparatus according to claim 1, wherein the processing unit can be placed in both a vertical position in which the image forming member and the developing agent holding member are aligned in a vertical direction, and in a horizontal position in which the image forming member and the developing agent holding member are aligned in a horizontal direction, and the processing unit includes a first contacting portion, which contacts an installation plane when the processing unit is placed in the vertical position, and a second contacting portion, which contacts the installation plane when the processing unit is placed in the horizontal position.

18. The image forming apparatus according to claim 1, wherein the processing unit includes a charging device that is disposed opposite to the image holding member and electrically charges the image holding member, and wherein the charging device is movable between a first position where the image holding member and the charging device are aligned in a processing unit attaching and detaching direction and a second position where the image holding member and the charging device are aligned in a direction orthogonal to the processing unit attaching and detaching direction.

19. The image forming apparatus according to claim 18, wherein the charging device is a first contacting portion when the charging device is located at the first position.

20. The image forming apparatus according to claim 19, wherein the charging device includes a charging wire and a cover covering the charging wire, and wherein the cover is the first contacting portion.

21. The image forming apparatus according to claim 1, wherein a filling aperture is provided to one wall, in a longitudinal direction of the developing agent holding member, of the developing agent storage portion at a position far from the developing agent holding member in order to pour the developing agent into the developing agent storage portion.

22. The image forming apparatus according to claim 1, wherein the developing agent remaining on the image holding member after the developing agent image held by the image holding member is transferred onto a recording medium, is collected by the developing agent holding member.

23. The image forming apparatus according to claim 1, wherein the developing agent is toner having substantially a spherical shape.

24. An image forming apparatus, comprising:

processing units for respective colors of developing agents each of which can be attached to and detached from a image forming apparatus body, the processing units including:

a developing portion that includes a developing agent storage chamber that stores developing agent therein and a developing agent holding member that holds the developing agent; and an image holding portion that includes an image holding member that holds a developing agent image that is formed by development of an electrostatic latent image by the developing agent held by the developing agent holding member, wherein the developing portion and the image holding portion can be attached to and detached from the image forming apparatus body in a state where the developing portion and the image holding portion are integrated with each other, and the developing portion can be attached to and detached from the image holding portion;

exposing devices for the respective colors of the developing agents, each of which is fixed to the image forming apparatus body and forms the electrostatic latent image onto the image holding member; and a cover member that is provided on a side opposite to a transfer position where the developing agent image held by the image holding member is transferred and that opens and closes with respect to the image forming apparatus body, wherein:

the processing units are attached to and detached from the image forming apparatus body via an opening defined by the cover member that is opened with respect to the image forming apparatus body, and the image holding member, the developing agent holding member and the developing agent storage chamber are overlapped in a direction to attach and detach the processing units, in each of the processing units;

the image holding portion includes a first guiding portion that guides the developing portion so that the developing agent holding member faces the image holding member, and the development portion includes a first guided portion that is guided by the first guiding portion.

25. The image forming apparatus according to claim 24, wherein the processing unit includes a supply device that supplies the developing agent stored in the developing agent storage chamber to the developing agent holding member, and the supply device, the developing agent holding member and the developing agent storage chamber are overlapped in the processing unit attaching and detaching direction.

26. The image forming apparatus according to claim 25, wherein the supply device is disposed in a plane of projection of the developing agent storage chamber in the processing unit attaching and detaching direction.

27. The image forming apparatus according to claim 25, wherein the supply device is provided between the developing agent holding member and the developing agent storage chamber.

28. The image forming apparatus according to claim 24, wherein the image holding member and the developing agent holding member are disposed in a plane of projection of the developing agent storage chamber in the processing unit attaching and detaching direction.

29. An image forming apparatus, comprising:

processing units for respective colors of developing agents each of which can be attached to and detached from an image forming apparatus body, the processing units including:

a developing portion that includes a developing agent storage chamber that stores developing agent therein and a developing agent holding member that holds the developing agent; and an image holding portion that includes an image holding member that holds a developing agent image that is formed by development of an electrostatic latent image by the developing agent held by the developing agent holding member, wherein the developing portion and the image holding portion can be attached to and detached from the image forming apparatus body in a state where the developing portion and the image holding portion are integrated with each other, and the developing portion can be attached to and detached from the image holding portion; and exposing devices for the respective colors of the developing agents, each of which is fixed to the image forming apparatus body and scans a laser beam to the image holding member in order to form the electrostatic latent image onto the image holding member, wherein:

the developing portion and the image holding portion can be attached to and detached from the image forming apparatus body in a state where the developing portion and the image holding portion are integrated with each other, and the developing portion can be attached to and detached from the image holding portion;

the image holding portion includes a first guiding portion that guides the developing portion so that the developing agent holding member faces the image holding member, and the developing portion includes a first guided portion that is guided by the first guiding portion.

30. An image forming apparatus, comprising:

processing unit for respective colors of developing agents each of which can be attached to and detached from an image forming apparatus body, the processing units including:

a developing agent storage chamber that stores developing agent therein;

a developing agent holding member that holds the developing agent; and an image holding member that holds a developing agent image that is formed by development of an electrostatic latent image by the developing agent held by the developing agent holding member;

exposing devices for the respective colors of the developing agents, each of which is fixed to the image forming apparatus body and scans a laser beam to the image holding member in order to form the electrostatic latent image onto the image holding member; and a cover member that is provided on a side opposite to a transfer position where the developing agent image held by the image holding member is transferred and that opens and closes with respect to the image forming apparatus body, wherein:

the processing units and the exposing devices are alternately disposed, and the processing units are attached to and detached from the image forming apparatus body via an opening defined by the cover member that is opened with respect to the image forming apparatus body; and the processing unit includes a charging device that is disposed opposite to the image holding member and electrically charges the image holding member, and wherein the charging device is movable between a first position where the image holding member and the charging device are aligned in a processing unit attaching and detaching direction and a second position where the image holding member and the charging device are aligned in a direction orthogonal to the processing unit attaching and detaching direction.

31. An image forming apparatus, comprising:

processing units for respective colors of developing agents each of which can be attached to and detached from a image forming apparatus body, the processing units including:

a developing agent storage chamber that stores developing agent therein;

a developing agent holding member that holds the developing agent; and an image holding member that holds a developing agent image that is formed by development of an electrostatic latent image by the developing agent held by the developing agent holding member;

exposing devices for the respective colors of the developing agents, each of which is fixed to the image forming apparatus body and forms the electrostatic latent image onto the image holding member; and a cover member that is provided on a side opposite to a transfer position where the developing agent image held by the image holding member is transferred and that opens and closes with respect to the image forming apparatus body, wherein:

the processing units are attached to and detached from the image forming apparatus body via an opening defined by the cover member that is opened with respect to the image forming apparatus body, and the image holding member, the developing agent holding member and the developing agent storage chamber are overlapped in a direction to attach and detach the processing units, in each of the processing units; and the processing unit includes a charging device that is disposed opposite to the image holding member and electrically charges the image holding member, and wherein the charging device is movable between a first position where the image holding member and the charging device are aligned in a processing unit attaching and detaching direction and a second position where the image holding member and the charging device are aligned in a direction orthogonal to the processing unit attaching and detaching direction.

32. An image forming apparatus, comprising:

processing units for respective colors of developing agents each of which can be attached to and detached from an image forming apparatus body, the processing units including:

a developing portion that includes a developing agent storage chamber that stores developing agent therein and a developing agent holding member that holds the developing agent; and an image holding member that includes an image holding member that holds a developing agent image that is formed by development of an electrostatic latent image by the developing agent held by the developing agent holding member; and exposing devices for the respective colors of the developing agents, each of which is fixed to the image forming apparatus body and scans a laser beam to the image holding member in order to form the electrostatic latent image onto the image holding member; wherein:

the developing portion and the image holding portion can be attached to and detached from the image forming apparatus body in a state where the developing portion and the image holding portion are integrated with each other, and the developing portion can be attached to and detached from the image holding portion; and the processing unit includes a charging device that is disposed opposite to the image holding member and electrically charges the image holding member, and wherein the charging device is movable between a first position where the image holding member and the charging device are aligned in a processing unit attaching and detaching direction and a second position where the image holding member and the charging device are aligned in a direction orthogonal to the processing unit attaching and detaching direction.

* * * * *